US007416178B2

(12) United States Patent
Ito

(10) Patent No.: US 7,416,178 B2
(45) Date of Patent: Aug. 26, 2008

(54) IMAGE-FORMING DEVICE

(75) Inventor: Sakae Ito, Nishikasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 510 days.

(21) Appl. No.: 11/153,389

(22) Filed: Jun. 16, 2005

(65) Prior Publication Data

US 2005/0281597 A1 Dec. 22, 2005

(30) Foreign Application Priority Data

Jun. 17, 2004 (JP) ..... 2004-180042

(51) Int. Cl.
*B65H 5/22* (2006.01)

(52) U.S. Cl. ..... 271/3.14; 271/4.01

(58) Field of Classification Search ..... 271/3.14, 271/4.01, 207; 347/104; 399/363, 107, 108, 399/124; D18/41, 44, 49, 36, 38, 39, 53
See application file for complete search history.

(56) References Cited

U.S. PATENT DOCUMENTS

D486,851 S * 2/2004 Ohashi ..... D18/39
6,690,901 B2 * 2/2004 Katsuyama et al. ..... 399/107
2004/0247337 A1 * 12/2004 Ohama et al. ..... 399/107

FOREIGN PATENT DOCUMENTS

| | | |
|---|---|---|
| JP | A-11-255399 | 9/1999 |
| JP | A-2001-063898 | 3/2001 |
| JP | A-2001-313757 | 11/2001 |
| JP | A-2002-287449 | 10/2002 |

* cited by examiner

*Primary Examiner*—David H Bollinger
(74) *Attorney, Agent, or Firm*—Oliff & Berridge, PLC

(57) ABSTRACT

An image-forming device includes: an image-forming unit; a sheet discharge unit; a sheet support unit; a top cover; and a panel. The image-forming unit forms images on a recording sheet. The sheet discharge unit discharges, in a sheet discharging direction, a recording sheet formed with an image by the image-forming unit. The sheet support unit is disposed above the image-forming unit, and supports sheet discharged from the sheet discharge unit. The top cover is disposed above the sheet support unit so as to cover the sheet support unit with a underside surface of the top cover opposing a top surface of the sheet support unit. The top cover has a front side and a rear side in the sheet discharge direction, the front side being on a downstream side of the rear side in the sheet discharge direction. The panel is disposed on the front side of the top cover and includes at least one of a control unit and a display unit on the top thereof. An opening is formed between the panel and the sheet support unit through which the recording sheet can be retrieved. A top surface and a underside surface of the panel slopes downward from the rear side to the front side.

13 Claims, 14 Drawing Sheets

IMAGE-FORMING DEVICE

BACKGROUND OF THE INVENTION

1. Field of the Invention

The present invention relates to an image-forming device.

2. Description of Related Art

A multifunction device such as that disclosed in Japanese unexamined patent application publication No. 2001-63898 having a control panel disposed on a discharge tray is well known in the art. This type of multifunction device is configured with a main reading unit body for scanning an original document and a control panel disposed adjacent to the main reading unit body on one end.

SUMMARY OF THE INVENTION

It is an object of the present invention to provide a compact image-forming device having a panel while maintaining sufficient ease of viewing and operating the panel.

In order to attain the above and other objects, the present invention provides an image-forming device including: an image-forming unit; a sheet discharge unit; a sheet support unit; a top cover; and a panel. The image-forming unit forms images on a recording sheet. The sheet discharge unit discharges, in a sheet discharging direction, a recording sheet formed with an image by the image-forming unit. The sheet support unit is disposed above the image-forming unit, and supports sheet discharged from the sheet discharge unit. The top cover is disposed above the sheet support unit so as to cover the sheet support unit with a underside surface of the top cover opposing a top surface of the sheet support unit. The top cover has a front side and a rear side in the sheet discharge direction, the front side being on a downstream side of the rear side in the sheet discharge direction. The panel is disposed on the front side of the top cover and includes at least one of a control unit and a display unit on the top thereof. An opening is formed between the panel and the sheet support unit through which the recording sheet can be retrieved. A top surface and a underside surface of the panel slopes downward from the rear side to the front side.

BRIEF DESCRIPTION OF THE DRAWINGS

The above and other objects, features, and advantages of the invention will become more apparent from reading the following description of the preferred embodiments taken in connection with the accompanying drawings in which:

FIG. 3(*b*) is an explanatory diagram illustrating the structure of a reading unit;

FIG. 9(*b*) is an explanatory diagram showing the multifunction device of the first embodiment when the ADF is in the upward opened state;

DETAILED DESCRIPTION OF THE PREFERRED EMBODIMENTS

First Embodiment

A multifunction device 1 according to a first embodiment of the present invention will be described while referring to FIGS. 1 through 10.

Figure 1:
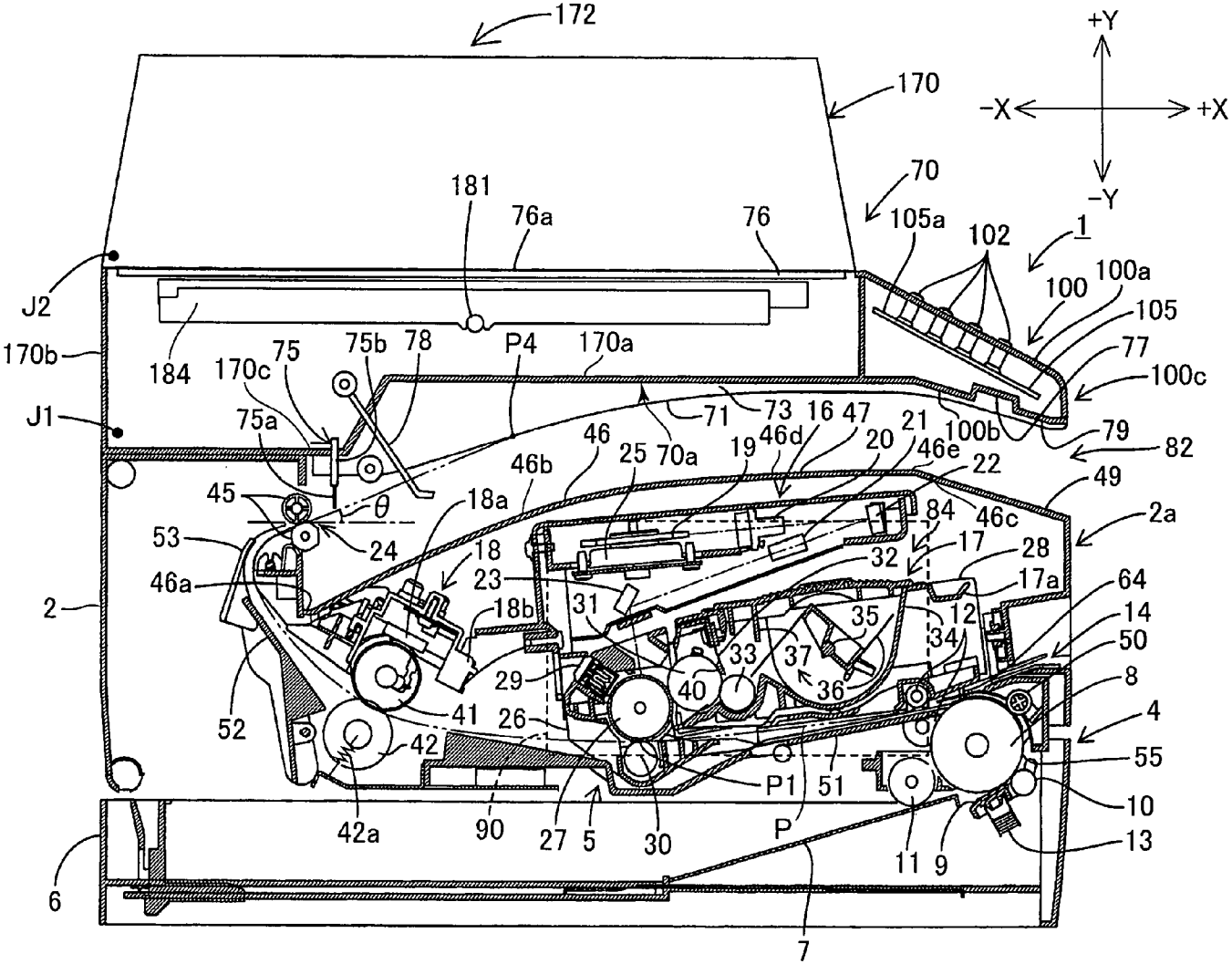
FIG. 1 is a side cross-sectional view showing the structure of a multifunction device according to a first embodiment of the present invention.

In FIG. 1, the multifunction device 1 is viewed along the axial direction of various rollers described later. In this drawing, the near side is referred to as the left side of the multifunction device 1, and the far side as the right side. Front and rear directions are also specified in the following description as horizontal directions with respect to the multifunction device 1 when the multifunction device 1 is placed on a level surface, wherein the front of the multifunction device 1 is the side toward which paper is discharged via a paper discharge port 24 and the rear side being the side opposite the front side. Up and down directions are also specified as vertical directions with respect to the multifunction device 1 when the multifunction device 1 is placed on a level surface. In FIG. 1, the front-to-rear direction is indicated by an X-axis, wherein the +X side denotes the front side and the −X side the rear side. The up and down direction is similarly indicated by a Y-axis, wherein the +Y side denotes the upward side and the −Y side the downward side. Thus, the expressions "front", "rear", "upper", "lower", "right", and "left" are used to define the various parts when the multifunction device 1 is disposed in an orientation in which it is intended to be used.

Figure 2:
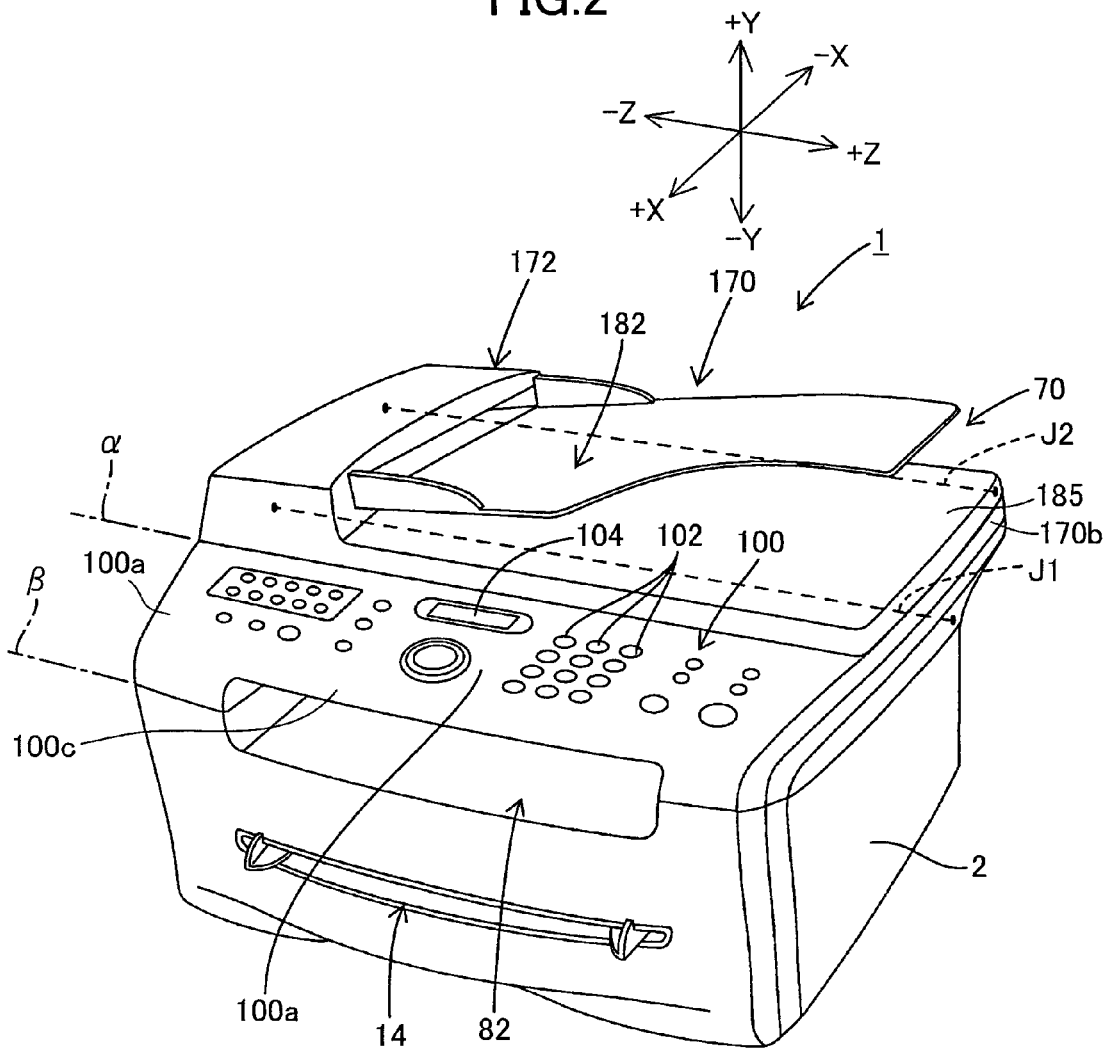
FIG. 2 is a perspective view of the multifunction device according to the first embodiment.
Figure 3A:
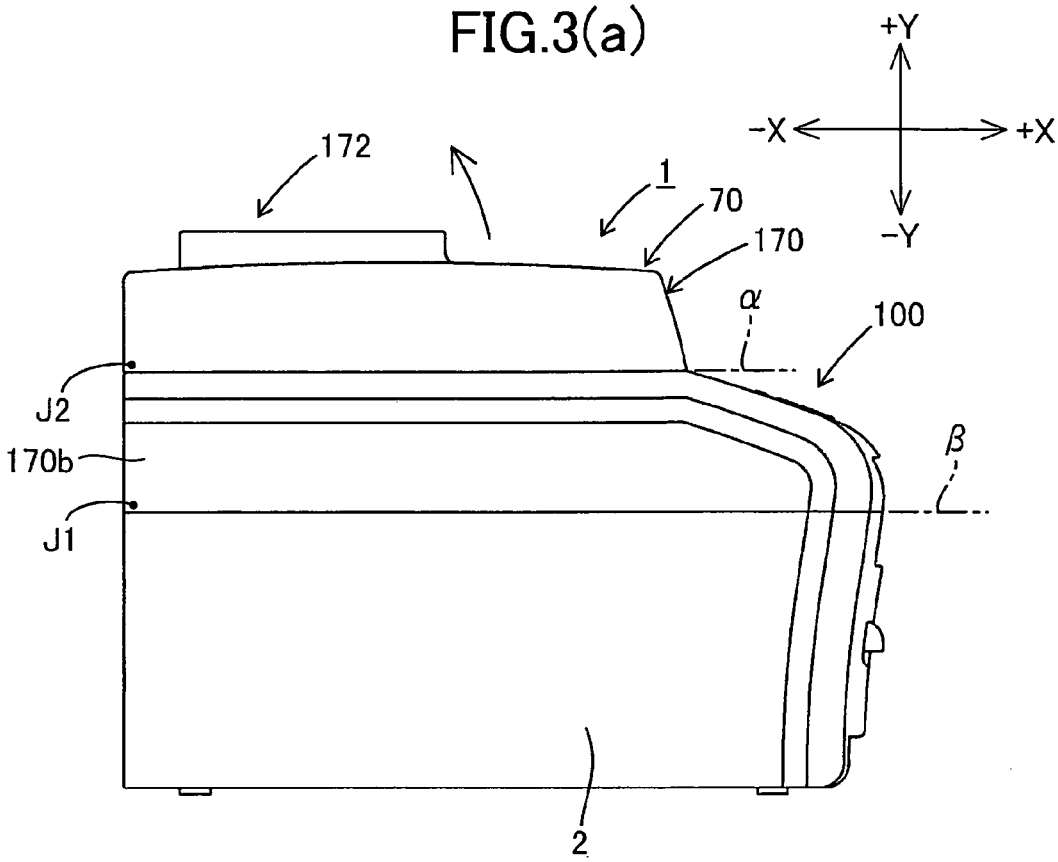
FIG. 3(*a*) is a side view showing the multifunction device of the first embodiment.
Figure 3B:
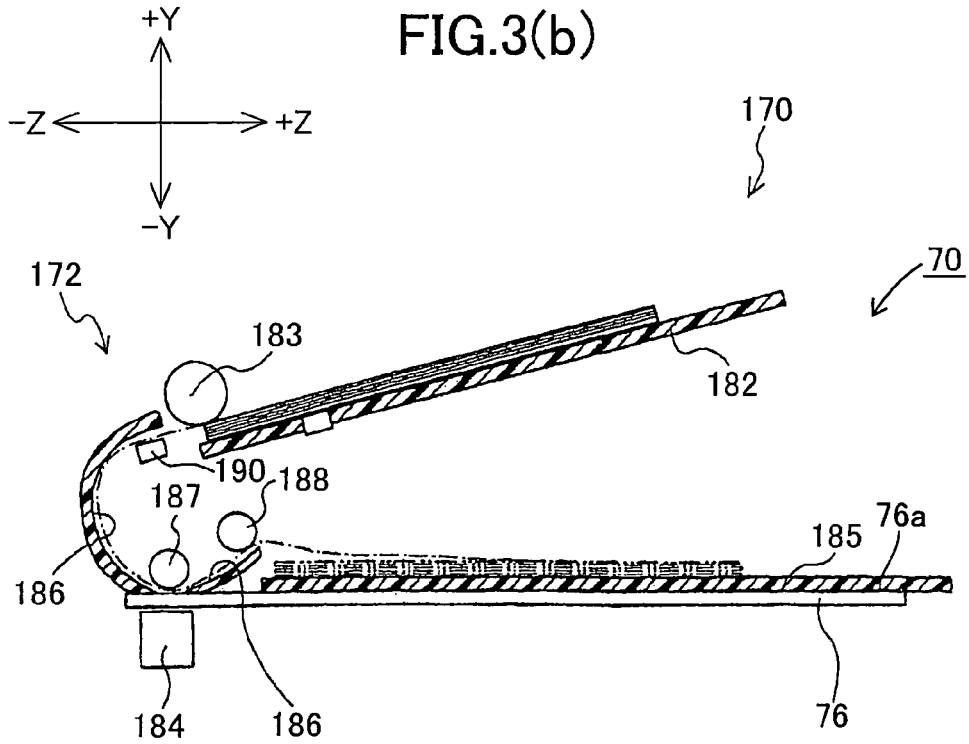

As shown in FIG. 1, the multifunction device 1 includes a main casing 2, the outward appearance of which can be seen in FIG. 2 and FIG. 3(*a*); and, within the main casing 2, a feeder unit 4 for supplying a paper 3, an image-forming unit 5 for forming prescribed images on the paper 3 supplied from the feeder unit 4, and the like. An image reading unit 70 is mounted above the main casing 2.

A discharge tray 46 is provided above the image-forming unit 5 for receiving and maintaining the paper 3 that has been discharged from the image-forming unit 5 after the image-forming unit 5 has formed a prescribed image thereon.

As shown in FIG. 1, the feeder unit 4 is provided with a paper cassette 6, a paper pressing plate 7 provided within the paper cassette 6, a conveying roller 11 provided above one end of the paper cassette 6, a feed roller 8 and a separation pad 9, a spring 13 provided beneath the separation pad 9, a pinch roller 10 facing the feed roller 8, a paper-dust removal roller 50, and registration rollers 12 provided on the downstream side of the paper-dust removal roller 50 in the conveying direction of the paper 3.

Paper fed from the front side of the paper cassette 6 by the conveying roller 11, feed roller 8, and pinch roller 10 is reversed in direction by a guide unit 55 so as to be moving toward the rear of the multifunction device 1. In this way, the paper is conveyed to the image-forming unit 5 disposed above the paper cassette 6.

Next, each component of the multifunction device 1 will be described in greater detail.

The paper cassette 6 is loaded in a removable manner into a base portion of the main casing 2, for storing the paper 3 in a stack manner. The paper cassette 6 is pulled out from a front side of the multifunction device 1 when the paper 3 is to be replenished. When the paper cassette 6 is pulled out, the feeder unit 4 is divided into two parts, an upper part and a lower part, at a location between the feed roller 8 and the separation pad 9. The paper cassette 6 is pulled out from the multifunction device 1 together with the pinch roller 10, the separation pad 9, and the spring 13.

The paper pressing plate 7 is supported in a pivoting manner about one end thereof that is further from the feed roller 8, so that the other end of the paper pressing plate 7 that is closer to the feed roller 8 can move up or down. The paper pressing plate 7 is urged upward by a spring (not shown). Accordingly, as the amount of the stacked paper 3 thereon increases, the paper pressing plate 7 is pressed downward against the elastic force of the spring about the one end of paper pressing plate 7.

The conveying roller 11 is in contact with the uppermost sheet of the paper 3 stacked on the paper pressing plate 7. The conveying roller 11 feeds the paper 3 to the position between the feed roller 8 and the separation pad 9, from which the feed roller 8 conveys the paper 3.

The separation pad 9 is disposed at the position facing the feed roller 8. The separation pad 9 is pressed to the feed roller 8 by the spring 13. The separation pad 9 prevents a plurality of sheets from being fed to a paper conveying path P (indicated by a two-dots-and-chain line in FIG. 1) simultaneously. Any sheets of the paper 3 other than the uppermost sheet 3 are held back by the separation pad 9, even if the plurality of sheets of the paper 3 is fed by the conveying roller 11 to the separation pad 9. This structure ensures that one sheet of paper 3 is supplied out of the paper cassette 6 by the feed roller 8 once.

The feed roller 8 conveys the paper 3 along the paper conveying path P to the registration rollers 12. While the feed roller 8 conveys the paper 3 along the paper conveying path P, the paper-dust removal roller 50 removes paper-dust from the paper 3.

A part of the paper conveying path P is inclined rearward downwardly from the top edge of the feed roller 8 to a transfer position P1. That is, the transfer position P1 is positioned lower than the top edge of the feed roller B. It is noted that most of the part of the paper conveying path P from the top edge of the feed roller 8 to the transfer position P1 is defined between a base portion of a process unit 17 to be described later and a guide member 51 provided the main casing 2 side.

The feed roller 8 reverses the conveying direction of the paper 3 by approximately 180 degrees before sending the paper 3 to the registration rollers 12. If the paper 3 is a thick paper such as a postcard and if the paper 3 obtains a large curvature by the feed roller 8, the paper 3 may become folded or may not reach the registration rollers 12 due to the stiffness against bending of the paper 3.

To avoid the above troubles, the feed roller 8 has a larger diameter than those of a photosensitive drum 27 and a pressure roller 42 to be described later. In this embodiment, the photosensitive drum 27 has a diameter of 24 mm. The pressure roller 42 and the feed roller 8 have diameters of 25 mm and 33 mm, respectively. Because the feed roller 8 has a relatively large diameter to make the curvature of the rounded paper 3 small, the feed roller 8 can convey the paper 3 in a suitable manner without folding the paper 3.

The registration rollers 12 are configured of a pair of rollers. The registration rollers 12 are controlled by a control device (not shown) mounted on a circuit board 90 that will be described later, in response to an output signal from a position sensor 64 located in the vicinity of the feed roller 8. The position sensor 64 is of a mechanical type. The control device causes the registration rollers 12 to correct the inclination of the paper 3. In other words, the control device suspends the registration rollers 12 when the position sensor 64 detects the leading edge of the paper 3 while the feed roller 8 is conveying the paper 3. When the paper 3 comes into contact with the registration rollers 12 and goes slackened, the control device again rotates the registration rollers 12 to send the paper 3 to the image-forming unit 5.

A manual paper-supply port 14 for supplying the paper 3 to the registration rollers 12 from the front of the multifunction device 1 is formed slightly above the feed roller 8. Accordingly, the paper 3 can be fed to the paper conveying path P from the manual paper-supply port 14.

The image-forming unit 5 is provided with a scanning unit 16, the process unit 17, and a fixing unit 18.

The scanning unit 16 is disposed in the upper portion of the main casing 2. The scanning unit 16 includes a laser generating unit (not shown), a polygon mirror 19 rotated by a polygon motor 25, lenses 20 and 21, and mirrors 22 and 23. The laser generating unit emits a laser beam on the basis of predetermined image data. The polygon mirror 19, the lens 20, the mirror 22, the lens 21, and the mirror 23 reflect or pass the laser beam in sequence, as shown by the one-dot-dash lines in FIG. 1. The scanning unit 16 then irradiates and scans the surface of the photosensitive drum 27 of the process unit 17 with the laser beam at a high speed.

More specifically, the polygon mirror 19 is located exactly above the photosensitive drum 27 and the transfer position P1 in the scanning unit 16. The polygon mirror 19 reflects the laser beam to direct the laser beam to the mirror 22 in a substantially horizontal direction. The mirror 22 then reflects the laser beam to the mirror 23 that is positioned immediately below the polygon mirror 19. In other words, the mirror 22 reflects the laser beam which falls incident thereon, at an acute angle of about 15° downward from the horizontal direction.

The housing of the scanning unit 16 has a suitable size and shape that do not interfere with the optical path of the laser beam. More specifically, the upper plate of the scanning unit 16 extends in a substantially horizontal direction, but at a slightly slant, with its rear end being lower than the front end. The lower plate of the scanning unit 16 is at a larger slant than the upper plate, so that the rear end of the lower plate is lower than the front end thereof. Therefore, the scanning unit 16 has a tapered shape that narrows from the rear side at the vicinity of the polygon mirror 19 and above the transfer position P1 to the front side adjacent to the feed roller 8.

Figure 4:
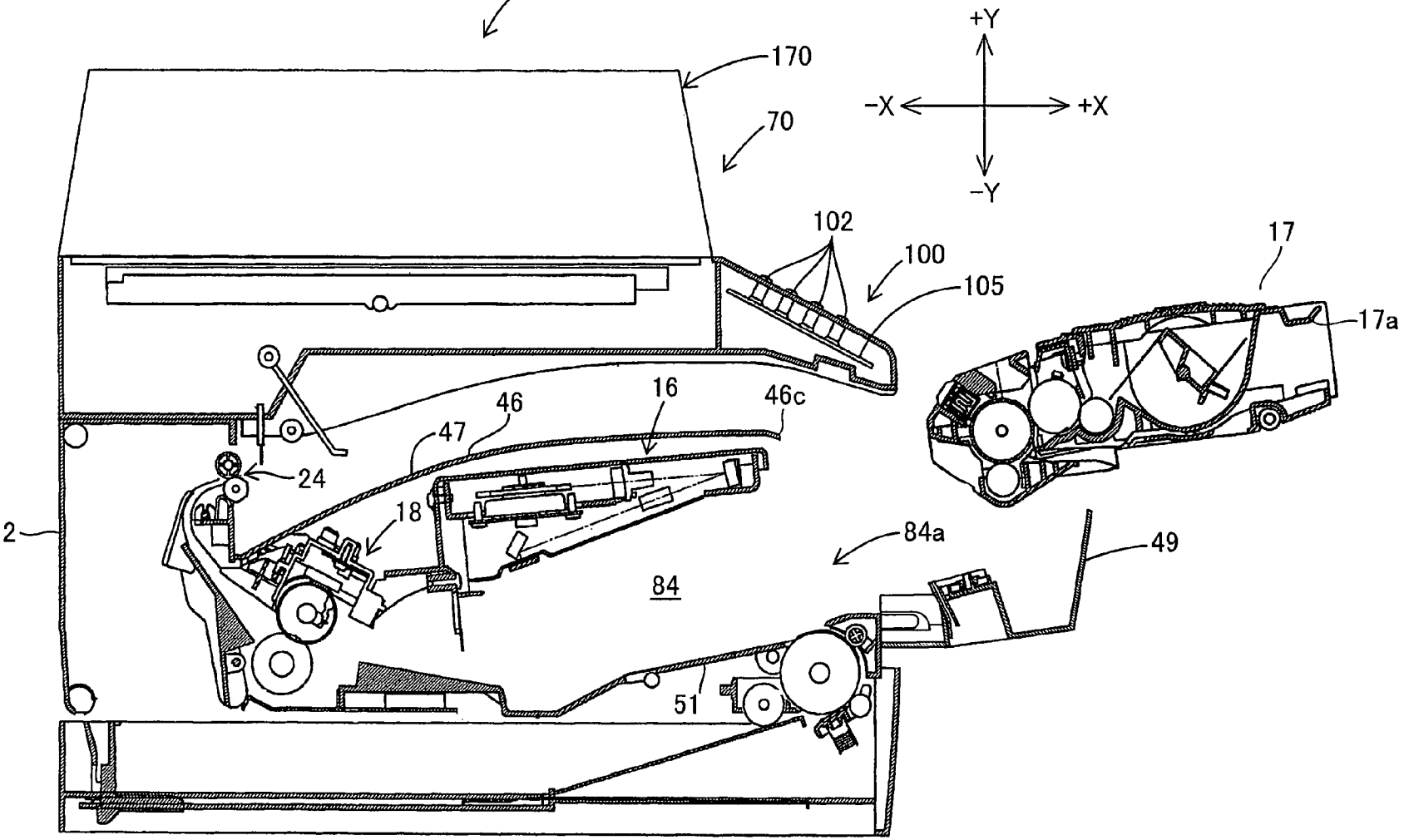
FIG. 4 is an explanatory diagram showing the multifunction device according to the first embodiment with a process unit removed therefrom.

As shown in FIG. 1 and FIG. 4, the process unit 17 is detachably mounted in the main casing 2. An accommodating section 84 is formed in the main casing 2 beneath the discharge tray 46 for accommodating the process unit 17. As shown in FIG. 4, an opening 84*a* in communication with the accommodating section 84 is formed in the front end of the main casing 2. The process unit 17 can be mounted in or removed from the accommodating section 84 via the opening 84*a*.

The process unit 17 is loaded in a removable manner into the main casing 2. When the process unit 17 is mounted in the main casing 2, the process unit 17 is positioned below the scanning unit 16. In other words, the process unit 17 is loaded into or pulled out of the casing 2 in the substantially horizontal, front-and-rear direction.

The process unit 17 is configured of a drum cartridge 26 and a developing cartridge 28. A space gap is formed between the process unit 17 and the scanning unit 16. The drum cartridge 26 is provided with the photosensitive drum 27, a scorotron-type charger 29, and a transfer roller 30. The developing cartridge 28 is provided with a developer roller 31, a layer thickness regulation blade 32, a toner supply roller 33, and a toner box 34. The developing cartridge 28 can be attached to and removed from the drum cartridge 26.

The photosensitive drum 27 and the toner box 34 occupy a comparatively large space in the main casing 2. The photosensitive drum 27 and the toner box 34 are positioned not exactly above the registration rollers 12 or the feed roller 8 that also occupies a comparatively large space in the vicinity of the process unit 17.

The toner box 34 is filled with toner. An agitator 36 is supported by a rotational shaft 35 provided at the center of the toner box 34 to rotate clockwise. The rotating agitator agitates the toner within the toner box 34 to discharge the toner through a toner supply port 37 on the toner box 34.

The toner supply roller 33 is positioned rear to the toner supply port 37 to rotate counterclockwise. The developer roller 31 is positioned facing the toner supply roller 33. The toner supply roller 33 and the developer roller 31 are in contact with each other so that each of rollers 31 and 33 is compressed to a certain degree.

The toner supply roller 33 is a roller having a metal roller shaft and being covered with an electrically conductive foamed material. The developer roller 31 is a roller having a metal roller shaft and being covered with an electrically conductive and nonmagnetic rubber material. More specifically, the roller portion of the developer roller 31 is such that the surface of a main roller made of silicone rubber or an electrically conductive urethane rubber including carbon particles is covered with a coating layer of urethane rubber or silicone rubber including fluoride. In the operation of the developer roller 31, a bias voltage is applied to the developer roller 31.

The layer thickness regulation blade 32 is positioned in the vicinity of the developer roller 31. The layer thickness regulation blade 32 has a pressure portion 40 made of an insulating silicone rubber on a leading-edge of a main blade made of a metal leaf spring. The pressure portion 40 has a semicircular section. The layer thickness regulation blade 32 is supported on the developing cartridge 28 at a position close to the developer roller 31. The pressure portion 40 is urged to the developer roller 31 by the elastic force of the main blade.

The rotation of the toner supply roller 33 feeds toner passed through the toner supply port 37 to the developer roller 31. At this time, the toner is charged positively due to the friction between the toner supply roller 33 and the developer roller 31. The rotation of the developer roller 31 feeds the toner on the developer roller 31 to a gap between the developer roller 31 and the pressure portion 40 of the layer thickness regulation blade 32. The toner is further charged positively due to the friction between the developer roller 31 and the pressure portion 40 and is then carried on the developer roller 31 as a thin layer having a constant thickness.

The photosensitive drum 27 is positioned rear to the developer roller 31 to rotate clockwise while facing the developer roller 31. The photosensitive drum 27 has a main drum that is grounded and has a surface made of a photosensitive layer such as polycarbonate having positively charging nature. The photosensitive drum 27 is rotated by the driving force of a main motor (not shown).

The scorotron-type charger 29 is positioned at a predetermined distance from the photosensitive drum 27 not so as to touch the photosensitive drum 27. In particular, the scorotron-type charger 29 is positioned in the radial direction of the photosensitive drum 27 at approximately 30 degrees above the horizontal direction. The scorotron-type charger 29 is a positively charging scorotron type of charger that generates a corona discharge from charger wires of tungsten. The scorotron-type charger 29 charges the surface of the photosensitive drum 27 uniformly and positively.

The surface of the photosensitive drum 27 is first uniformly and positively charged by the scotron-type charger 29, as the photosensitive drum 27 rotates. The photosensitive drum 27 is then exposed by a high-speed scan of the laser beam from the scanning unit 16, so that a latent electrostatic image based on predetermined image data is formed on the surface of the photosensitive drum 27.

Next, as the developer roller 31 rotates, the positively charged toner on the developer roller 31 becomes into contact with the photosensitive drum 27. At this time, the toner is supplied to the latent electrostatic image on the surface of the photosensitive drum 27, that is, the portions of the photosensitive drum 27 which have been exposed by the laser beam, and have the resultant reduced potential. The toner supplied to the exposed portions makes a visible image, thereby achieving negative development.

The transfer roller 30 is positioned below the photosensitive drum 27, facing the photosensitive drum 27, and is supported by the drum cartridge 26 to be rotatable counterclockwise. The transfer roller 30 has a metal roller shaft covered with an ion electrically conductive rubber material. A transfer bias is applied to the transfer roller 30 during the operation of the transfer roller 30. The visible image carried on the surface of the photosensitive drum 27 is transferred to the paper 3 as the paper 3 passes between the photosensitive drum 27 and the transfer roller 30 at the transfer position P1.

The fixing unit 18 is positioned on the downstream side of the process unit 17 in the paper conveying direction. The fixing unit 18 is provided with a heat roller 41 having gears, the pressure roller 42 for pressing against the heat roller 41, and a thermostat 18*a*. The heat roller 41 and the thermostat 18*a* are covered by a cover 18*b*.

The heat roller 41 is made of metal and is provided with a halogen lamp for heating. The pressure roller 42 is made of resilient body such as silicone rubber. The pressure roller 42 is provided with a spring 42*a* that presses or urges the pressure roller 42 from below to the central axis of the heat roller 41 in a rotatable manner. The heat roller 41 is in contact with one of the pressure roller 42 and the paper 3. The heat roller 41 rotates in synchronization with the pressure roller 42.

The thermostat 18*a* is made of a bimetal strip. The thermostat 18*a* turns on or off the heater for heating the heat roller 41 in accordance with the amount of the heat generated by the heat roller 41, thereby preventing the pressure roller 42 from being heated at a higher temperature than a predetermined temperature.

The thermostat 18*a* is positioned above the heat roller 41 and on the imaginary line extending through the rotational centers of the heat roller 41 and the pressure roller 42. The position of the thermostat 18*a* contributes a lower positioning of an upstream side edge 46*a* of the discharge tray 46 (to be described later), compared to a comparative configuration in which the thermostat 18*a* is either exactly above the heat roller 41 or rearward from exactly above the heat roller 41.

The cover 18*b* has a shape such as to cover the front and top of the heat roller 41. Therefore, the cover 18*b* prevents the heat generated by the heat roller 41 from radiating out of the fixing unit 18 in order to protect other components such as the scanning unit 16 in the main casing 2 from heat. The cover 18*b* merely supports the central shaft (not shown) of the pressure roller 42 in a rotatable manner and so that the pressure roller 42 can move in the pressing direction of the spring 42*a*. The lower portion of the heat roller 41 and the entire portion of the pressure roller 42 are exposed from the cover 18*b*. For that reason, the height of the multifunction device 1 can be reduced by the thickness of the cover 18*b*, in comparison with a configuration in which the cover 18*b* also covered the lower portion of the heat roller 41 and the entire portion of the pressure roller 42.

In the fixing unit 18, the heat roller 41 fixes the toner that has been transferred on the paper 3 by heating and pressing the paper 3 when the paper 3 is passing between the heat roller 41 and the pressure roller 42. The heat roller 41 then conveys the paper 3 having the fixed image thereon, along a paper-delivery path formed by guide members 52 and 53 to a pair of discharge rollers 45. The pair of the discharge rollers 45 ejects the paper 3 through the discharge port 24 onto the discharge tray 46.

It is noted that a nip portion between the discharge rollers 45 is defined as a discharge point P2, at which a paper 3 leaves the discharge rollers 45. An angle θ is defined between the forward (horizontal) +X direction and a tangential direction of the discharge rollers 45 at the discharge point P2 when the multifunction device 1 is placed on a level surface. In this example, the angle θ is in a range of 0 to 90 degrees so that the tangential direction of the discharge rollers 45 at the discharge point P2 is slanted to extend upwardly forwardly.

If the paper 3 is made to bend abruptly after being heated by the heat roller 41, the paper 3 might not return from the curved state to the original flat state. In order to avoid the bend of the paper 3, the guide members 52 and 53 guide the heated paper 3 while maintaining the paper 3 in a substantially straight manner immediately after the paper 3 has exit from the heat roller 41. Then, the guide members 52 and 53 guide the paper 3, bending the paper 3 with a relatively large curvature, as the paper 3 approaches the pair of the discharge rollers 45.

The above-described configuration enables a lower positioning of the pair of discharge rollers 45, compared with a comparative case where the entire delivery path of the paper 3 is made with a smaller curvature. Accordingly, the multifunction device 1 can easily reduce its height, while preventing permanent bend of the paper 3.

It is noted that the heat roller 41 is constructed of a rigid body, while the pressure roller 42 is configured of a resilient body. This configuration produces curl in the paper in the paper conveying direction when the paper passes between the heat roller 41 and pressure roller 42. Accordingly, the leading edge of the paper discharged from the discharge rollers 45 has an upwardly convex shape in the paper discharging direction as indicated by the two-dots-and-chain line in FIG. 1.

Figure 10:
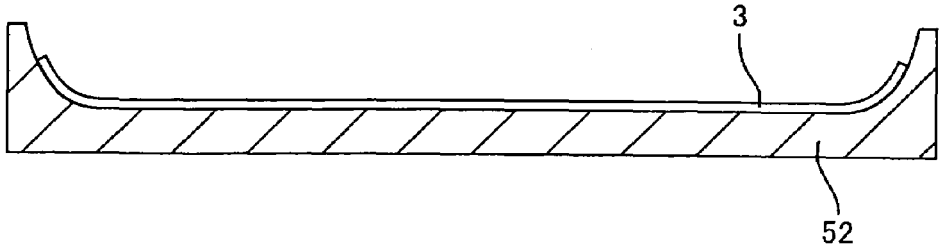
FIG. 10 is a cross-sectional view of a guide member used on the paper conveying path after the transfer unit.

FIG. 10 is a cross-sectional view of the guide member 52 along a widthwise direction (Z direction) that is orthogonal to the paper conveying direction. As shown in FIG. 10, the guide member 52 is partially curved on both widthwise ends. With this construction, a partial curl is generated in both widthwise edges of paper conveyed along the guide member 52. The discharge rollers 45 discharge paper 3 while maintaining the curved shape with respect to both of the widthwise direction and the conveying direction formed by the guide members 52 and 53. As a result, the side edges of the paper curve downward when the paper is discharged from the discharge rollers 45 as indicated by a two-dots-and-chain line in FIG. 7.

It is noted that along with or in place of this configuration, it is possible to generate curl by varying the diameter of the heat roller 41 such that the diameter on the axial ends (along the Z-axis) of the heat roller 41 is slightly smaller than the diameter in the axial center.

As shown in FIG. 1, the discharge tray 46 is provided above the image-forming unit 5 for supporting paper discharged from the discharge rollers 45. The discharge tray 46 has a top surface 47.

Figure 5:
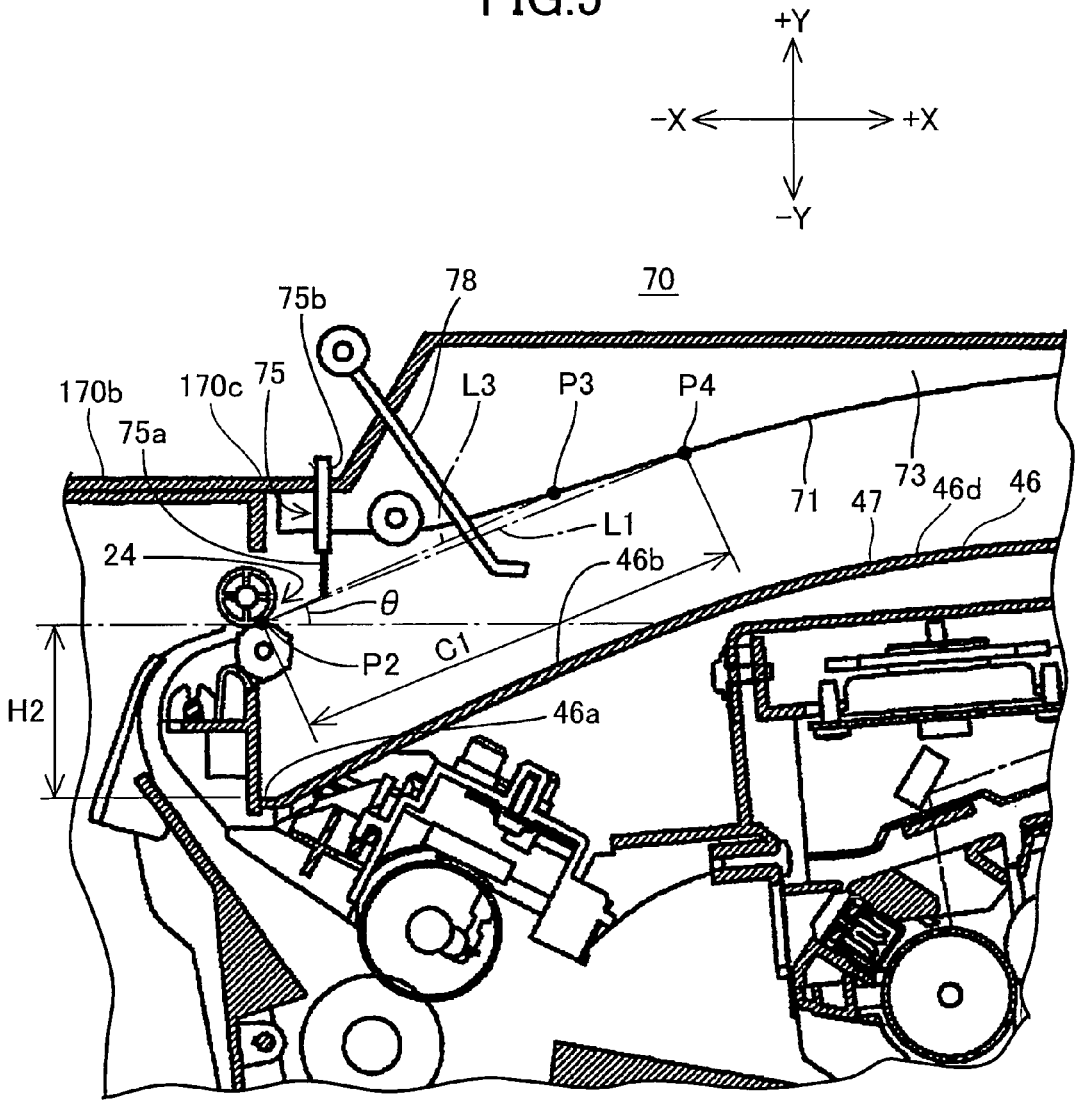
FIG. 5 is an enlarged side cross-sectional view showing the region around the paper discharge port.
Figure 6:
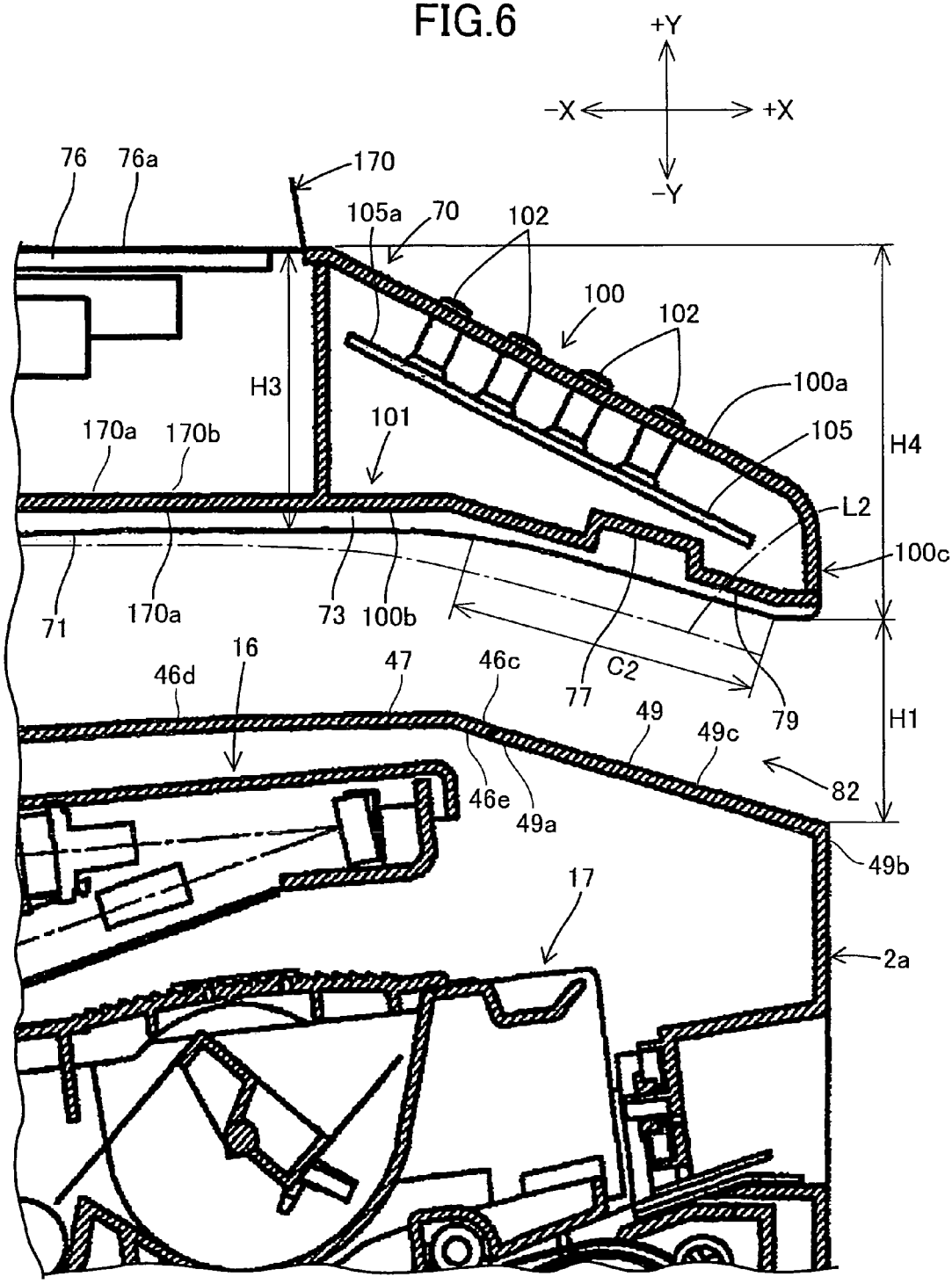
FIG. 6 is an enlarged side cross-sectional view showing the region around an opening through which the process unit is mounted and removed.

As shown in FIGS. 1, 5, and 6, the end of the discharge tray 46 near the pair of the discharge rollers 45 is called the upstream side edge 46*a* with respect to the direction that paper is discharged by the discharge rollers 45, and the opposite end as the downstream side edge 46*c*.

The discharge tray 46 includes: an upstream portion 46*b* near the upstream side 46*a*; a middle portion 46*d*; and a downstream portion 46*e* near the downstream side edge 46*c*. The middle portion 46*d* is located between the upstream portion 46*b* and the downstream portion 46*e* in the paper discharge direction (front-and-rear direction). In the upstream portion 46*b*, the top surface 47 of the discharge tray 46 slants upwardly forwardly from its rear edge (upstream side edge 46*a*) toward its front edge (border between the upstream portion 46*b* and the middle portion 46*d*). In the middle portion 46*d*, the top surface 47 extends substantially horizontally. In the downstream portion 46*e*, the top surface 47 slants downwardly forwardly from its rear edge (border between the middle portion 46*d* and the downstream portion 46*e*) toward its front edge (downstream side edge 46*c*).

As shown in FIGS. 1 and 6, the main casing 2 further has a cover 49. The front edge 49*b* of the cover 49 defines a front end 2*a* on the main casing 2. The rear edge 49*a* of the cover 49 is in abutment contact with the downstream side edge 46*c* of the discharge tray 46 when the cover 49 is closed as shown in FIGS. 1 and 6.

The top surface 49*c* of the cover 49 descends from its rear edge 49*a* to its front edge 49*b* smoothly continuously from the downstream portion 46*e* of the discharge tray 46. Thus, the discharge tray 46 and the cover 49 serve to cooperate to support the discharged sheets.

The circuit board 90 having the control device for controlling the rollers described above and the polygon mirror 19 is positioned on one outer side of the paper conveying path P in the vicinity of a side surface of the process unit 17, as shown by broken lines in FIG. 1.

When the process unit 17 is mounted in the multifunction device 1 as shown in FIG. 1, in order to remove the process unit 17 from the main casing 2, the user first opens the cover 49 disposed on the front of the multifunction device 1 to the position shown in FIG. 4. Here, the cover 49 rotates forward about a support shaft (not shown)

Then, the process unit 17 is pulled in a substantially horizontal direction from the front side of the multifunction device 1. When removed, the process unit 17 passes over the feed roller 8. As described above, since a space is formed between the process unit 17 and the scanning unit 16, the user can lift the process unit 17 toward the scanning unit 16 by a grip 17*a* positioned on the front of the process unit 17 (the side near the feed roller 8) and can pull the process unit 17 outward from this position. With this construction, the rear side of the process unit 17 (the transfer position P1 side) is less likely to get caught on the body of the multifunction device 1, enabling the user to smoothly pull out the process unit 17.

As shown in FIGS. 1-3(*a*), the image reading unit 70 is disposed above the discharge tray 46 so as to cover the same. The image reading unit 70 has an underside surface 70*a*. The underside surface 70*a* opposes the top surface 47 of the discharge tray 46. The underside surface 70*a* is made up from an underside surface 170*a* and a lower panel surface 100*b* as will be described later. On the underside surface 170*a*, an upstream side position 170*c* is defined as a location exactly above the upstream side edge 46*a* of the discharge tray 46.

The image reading unit 70 has a main reading unit body 170 and a control panel 100. The main reading unit body 170 has: a reader casing 170*b*; and an ADF (automatic document feeder) 172 mounted on the reader casing 170*b*. It is noted that only a general outline of the ADF 172 is depicted in FIG. 1. The reader casing 170*b* has the underside surface 170*a*. The reader casing 170*b* functions as a top cover for covering the discharge tray 46.

The control panel 100 extends farther toward the front side of the multifunction device 1 than the main reading unit body 170. In other words, the control panel 100 extends forwardly from the front edge of the reader casing 170*b*. The control panel 100 is disposed over a front part of the top surface 47 of the discharge tray 46 and the cover 49.

An opening 82 is defined between the control panel 100 and the front part of the discharge tray 46 and the cover 49, enabling the user to retrieve discharged paper stacked on the discharge tray 46. The opening 82 is formed in a downward slope.

The image reading unit body 170 is configured as a flatbed scanner. The main reading unit body 170 has: a contact image sensor (CIS) 184; a document support 76; and a shaft 181. The document support 76 is supported by the reader casing 170*b* to form a part of an upper surface of the reader casing 170*b* as shown in FIG. 1. The document support 76 is formed of a glass plate and has a document support surface 76*a* (top surface) for supporting an original document thereon. The CIS 184 and the document support 76 are mounted inside the reader casing 170*b* at a location below the document support 76. The shaft 181 extends in the Z direction. The CIS 184 is a line sensor extending along the X-axis (see FIG. 1). The CIS 184 has a plurality of photodiodes (not shown) arranged along the X-axis. The CIS 184 is slidably mounted on the shaft 181. The CIS 184 can move across the document support surface 76*a* in the Z direction along the shaft 181.

The ADF 172, mounted on the reader casing 170*b*, is for automatically conveying original documents one sheet at a time in a document conveying direction along the Z-axis.

As shown in FIGS. 2 and 3(*b*), the ADF 172 includes: a document tray 182; a discharge tray 185; a conveying path 186; a feed roller 183; a pressure roller 187; a discharge roller 188; and a paper sensor 190. The ADF 172 is mounted on the reader casing 170*b*, with the discharge tray 185 being located over the document support 76. The document tray 182 is for supporting thereon an original document to be subjected to the automatic document feeding operation. The conveying path 186 is formed in an arc for guiding a document from the document tray 182 onto the discharge tray 185. The feed roller 183 is disposed at the upstream end of the conveying path 186 in the document conveying direction, and is for separating the sheets of document on the document tray 182 and feeding the documents one sheet at a time onto the conveying path 186. The pressure roller 187 is disposed on the conveying path 186 at a location confronting the CIS 184 via the document support 76. The paper sensor 190 is disposed near the feed roller 183 along the conveying path 186 and is for detecting passage of the documents. The pressure roller 187 is for pressing the document against the document support 76 as the document passes over the CIS 184. The discharge roller 188 is disposed at the downstream end of the conveying path 186 with respect to the document conveying direction and is for discharging the document onto the discharge tray 185.

Figure 9A:
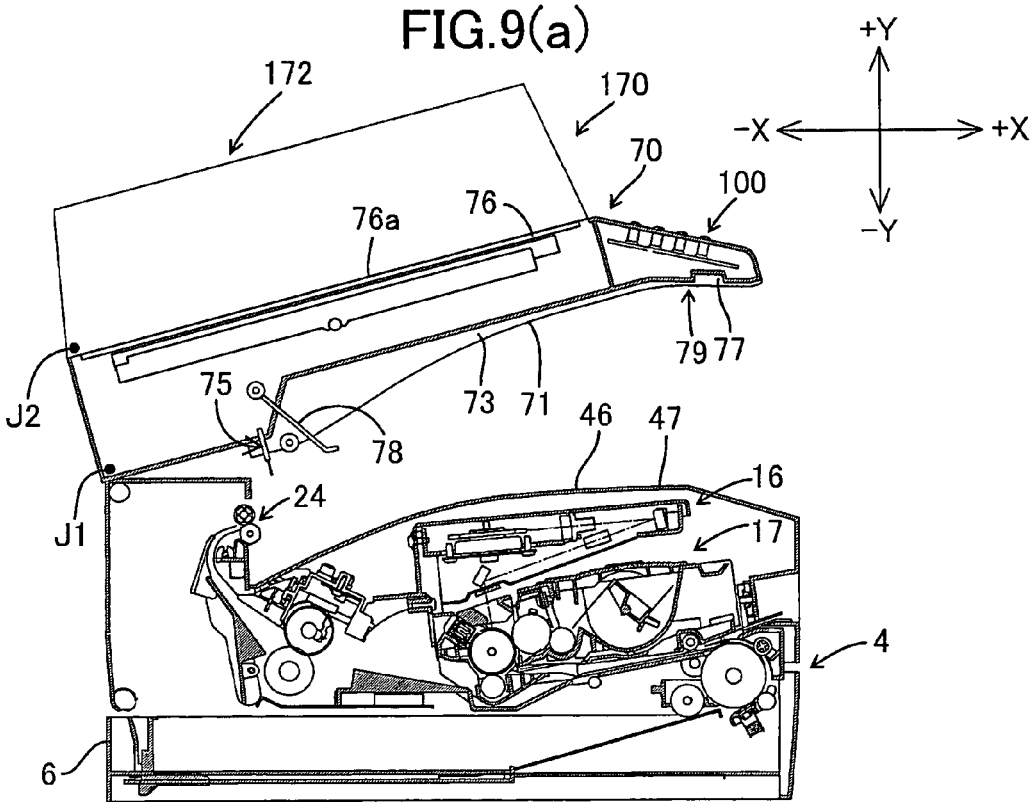
FIG. 9(*a*) is an explanatory diagram showing the multifunction device of the first embodiment when the reading unit is in an upward opened state.
Figure 9B:
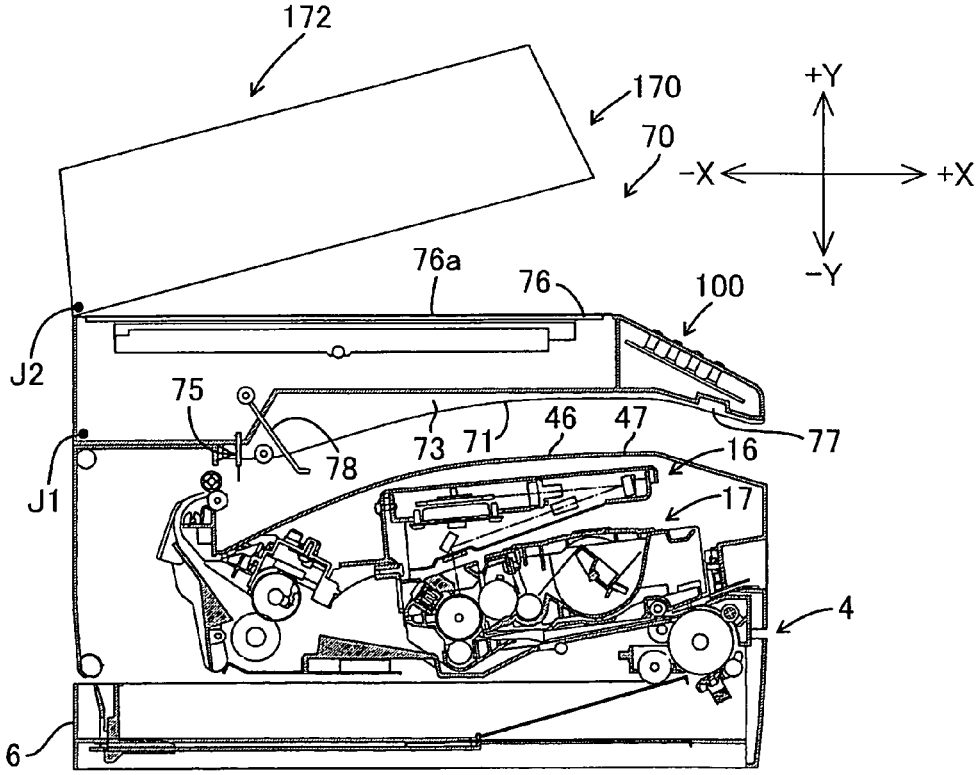

It is noted that the entire image reading unit 70 can be opened rearward from the main casing 2 as shown in FIG. 9(*a*). The ADF 172 can be opened rearward from the reader casing 170*b* as shown in FIG. 9(*b*). It is noted that only a general outline of the ADF 172 is depicted in FIGS. 9(*a*) and 9(*b*).

More specifically, as shown in FIGS. 2 and 3(*a*), the ADF 172 separates from the reader casing 170*b* at an imaginary plane α. The entire image reading unit 70 separates from the rest of the multifunction device 1 (main casing 2) at an imaginary plane β. The ADF 172 is configured to open rearward by rotating about a shaft indicated conceptually by reference numeral J2. The entire image reading unit 70 is also configured to open rearward by rotating about a shaft indicated conceptually by reference numeral J1.

With this type of flatbed structure, a user can control the image reading unit 70 to automatically scan a plurality of document sheets by using the ADF 172. The user can also scan books or other documents by not using the ADF 172. That is, the user can scan books or other documents by opening the ADF 172 as shown in FIG. 9(*b*) to expose the document support 76, and placing the document on the document support surface 76*a*.

Thus the image reading unit body 170 can scan a document either when the document is placed on the document support surface 76*a* of the document support 76 or when using the ADF 172. In the former case, the CIS 184 moves across the document support surface 76*a* in the Z direction along the shaft 181 (see FIG. 1), while scanning the document supported on the document support 76 one line at a time. The individual photodiodes in the CIS 184 receive reflected light when a light source (not shown) irradiates a strong light on the document, and the CIS 184 converts the intensity (brightness) of the reflected light for each pixel of the document to electric signals. By converting these signals to digital data with an A/D converter (not shown), the image reading unit body 170 reads the image formed on the document as image data.

In the latter case, the CIS 184 is fixed at the left end of the document support 76 so as to oppose the pressure roller 187 via the document support 76. While fixed in this position, the CIS 184 scans one line of the document at a time as the document is conveyed by the ADF 172.

As shown in FIGS. 1 and 6, the control panel 100 includes: an upper panel surface 100*a*, the lower panel surface 100*b*, and a front edge 100*c*.

An operating unit 102 including buttons and a display unit 104 are provided on the upper panel surface 100*a*. It is noted that only either the operating unit 102 or the display unit 104 may be provided on the top of the control panel 100.

The lower panel surface 100*b* has a declining extension 79 at its front part. The declining extension 79 declines gradually toward the front edge 100*c* (+X direction). Both of the upper panel surface 100*a* and the declining extension 79 slope downward toward the front side of the multifunction device 1.

The top surface 47 of the discharge tray 46 and the top surface 49*c* of the cover 49 also slope downward toward the front of the multifunction device 1 in the region opposite the declining extension 79. The slopes of the top surface 47 and the top surface 49*c* in the region opposite the declining extension 79 are substantially the same as that of the declining extension 79. In other words, the top surface 47 of the downstream portion 46*e* and the top surface 49*c* of the cover 49 slope downward toward the front of the multifunction device 1 at the same degree as the declining extension 79.

As shown in FIGS. 1 and 6, a panel circuit board 105 is disposed inside the control panel 100 and is electrically connected to the operating unit 102 and display unit 104. The panel circuit board 105 has a surface 105*a* sloped at substantially the same degree as the slopes of the upper panel surface 100*a* and the declining extension 79 of the lower panel surface 100*b*. It is noted that the surface 105*a* of the panel circuit board 105 may be sloped at substantially the same degree as at least one of the slopes of the upper panel surface 100*a* and of the declining extension 79.

The front edge 100*c* of the control panel 100 is positioned substantially flush with the front end 2*a* (front edge 49*b* of cover 49) with respect to the X-axis. With this construction, the front edge 100*c* of the control panel 100 does not protrude from the front end 2*a* of the main casing 2, thereby preventing the device 1 from becoming too large and forming a streamlined contour. Further, the control panel 100 is not so small as to recede rearward from the front end 2*a* of the main casing 2, but is maintained at an appropriate size for ease of operations.

The underside surface 170*a* of the main reading unit body 170 and the lower panel surface 100*b* of the control panel 100 are integrally formed into the underside surface 70*a* from a molded synthetic resin material. Hence, the underside surface 70*a* is configured to have a smooth, continuous surface from the underside surface 170*a* side to the lower panel surface 100*b* side.

Figure 8:
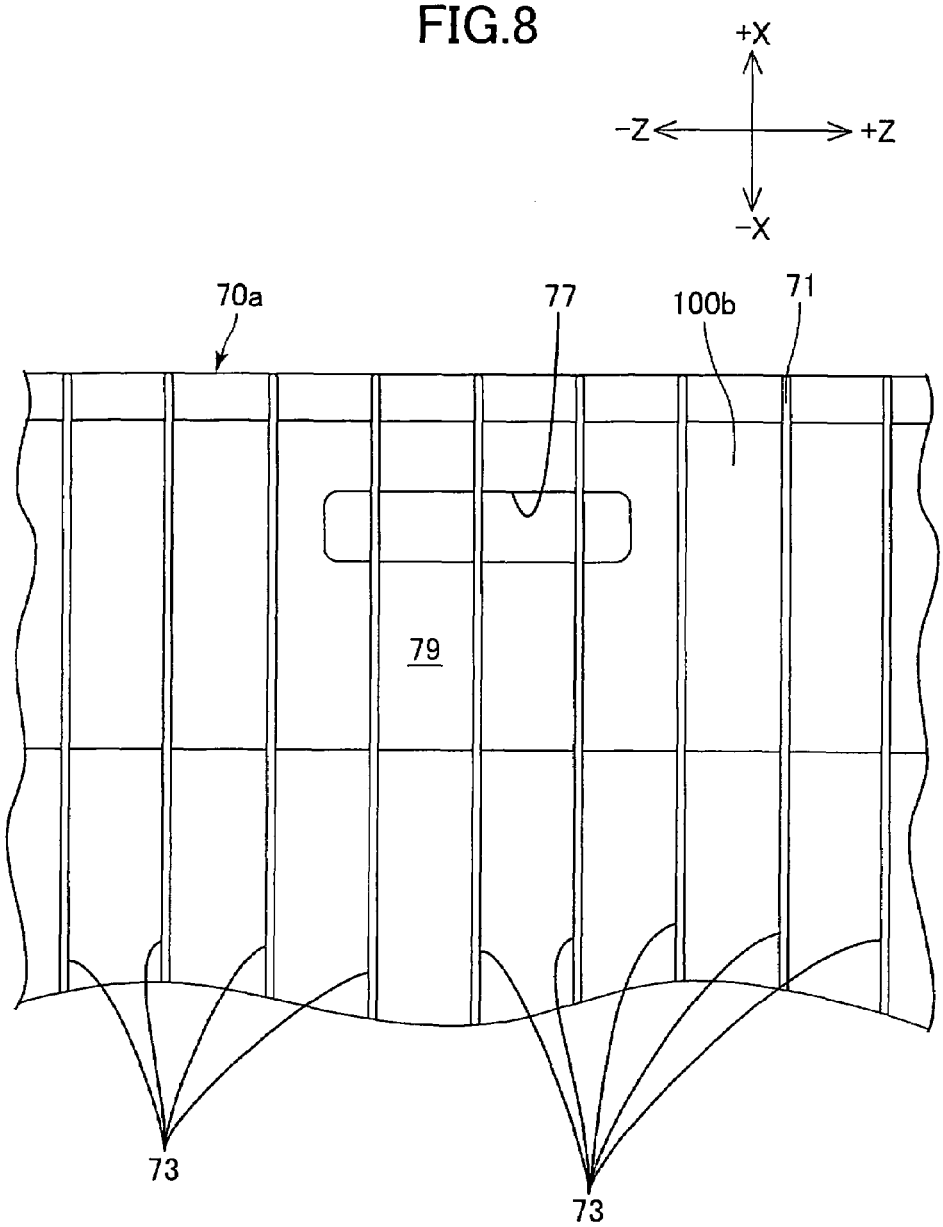
FIG. 8 is an enlarged bottom view showing part of the reading unit.

As shown in FIGS. 6 and 8, a grip part 77 is formed on the underside surface 70*a* of the image reading unit 70.

The grip part 77 is formed as a depression in the widthwise center of the image reading unit 70, and is recessed into the image reading unit 70 farther than the surface of the underside surface 70*a*. The grip part 77 is located on the declining extension 79 of the lower panel surface 100*b*.

To open the image reading unit 70 as shown in FIG. 9(*a*), the operator inserts fingers into the depressed area of the grip part 77 and lifts upward. Hence, the image reading unit 70 can be moved upward, separating the underside surface 70*a* of the image reading unit 70 from the top surface 47 of the discharge tray 46. This construction provides the user with better access to the discharge tray 46.

As shown in FIGS. 1 and 5-8, a plurality of guide ribs 73 protrude downward from the underside surface 70*a* of the image reading unit 70 and extend in the front-and-rear direction. The guide ribs 73 extend from the upstream side position 170*c* exactly above the upstream side edge 46*a* of the discharge tray 46 continuously toward the front end 100*c* of the control panel 100. In other words, the rear side edges of the guide ribs 73 are located on the upstream side position 170*c*, while the front side edges of the guide ribs 73 are located on the front edge 100*c*. The guide ribs 73 are provided over the depression of the grip part 77 as shown in FIG. 8. As shown in FIG. 6, the guide ribs 73 protrude farther downward than the bottom edge of the grip part 77, which is defined by the lower panel surface 100*b*.

As shown in FIGS. 1, 5, 6, and 8, each guide rib 73 has a lower edge 71. As shown in FIGS. 1, 5, and 6, the lower edge 71 of each guide rib 73 extends substantially parallel with the underside surface 70*a* in the XY plane. It is noted that the underside surface 70*a* and the lower edge 71 of each guide rib 73 may extend in a straight line or in a curved line in the XY plane. As shown in FIG. 8, the guide ribs 73 axe arranged parallel to one another in the widthwise direction (Z direction).

Figure 7:
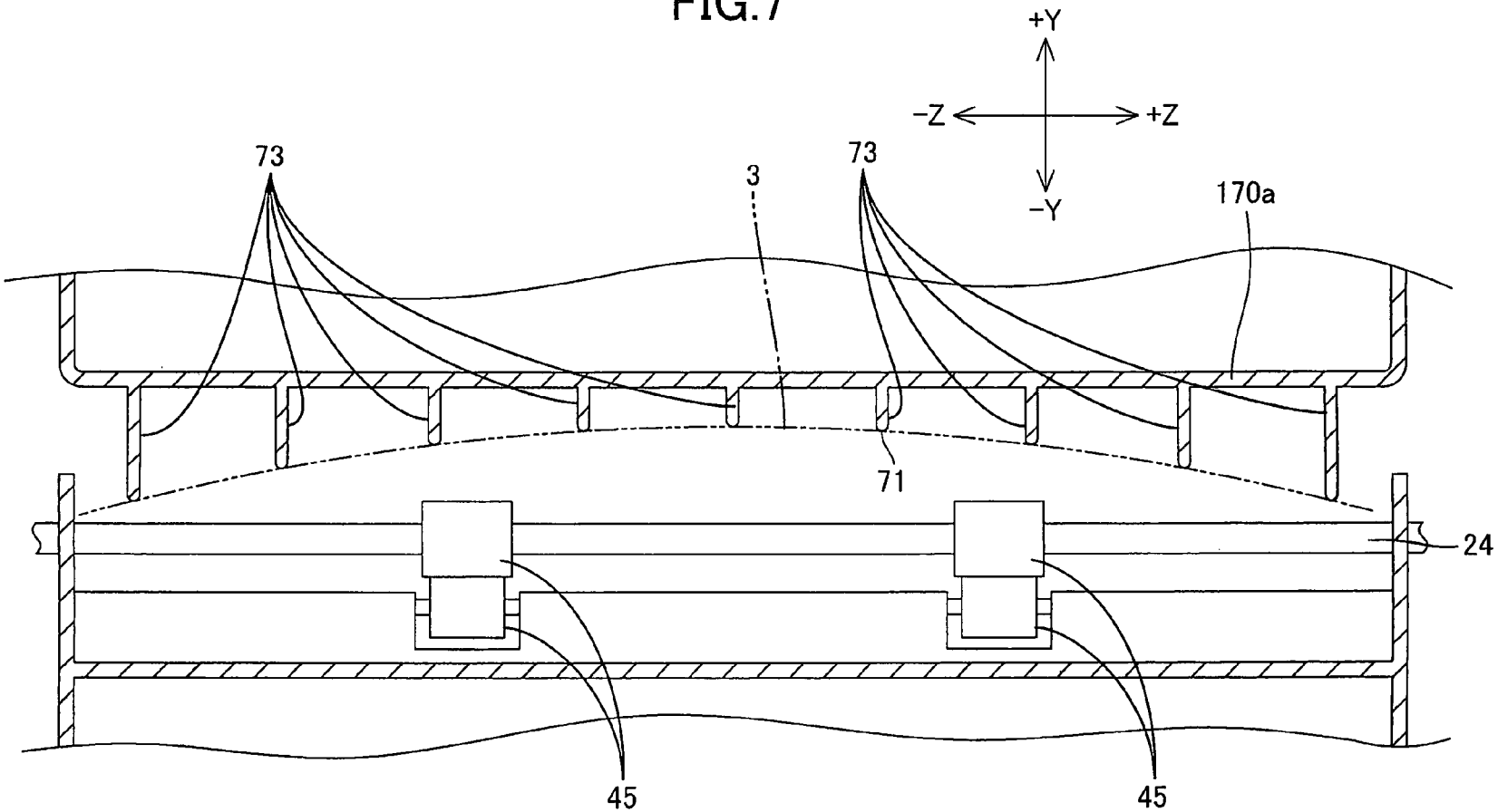
FIG. 7 is an explanatory diagram showing the structure around the paper discharge port.

As described already with reference to FIG. 7, the discharge rollers 45 discharge paper 3 while maintaining the convex shape formed by the guide members 52 and 53. Thus, the discharge rollers 45 discharge paper 3 in a curved state that is convex on the top with respect to the widthwise direction.

As shown in FIG. 7, the guide ribs 73 extend downward farther near the widthwise edges than the widthwise center at their parts near the upstream side position 170*c*. In other words, at their parts near the pair of the discharge rollers 45, the lower edges 71 of the guide ribs 73 near the widthwise edges are positioned lower than the lower edges 71 of the guide ribs 73 at the widthwise center.

Thus, the guide ribs 73 are configured to support at least the convex portion of the paper. This construction can easily determine the widthwise center of the paper discharged from the discharge rollers 45. Therefore, a plurality of sheets of discharged paper 3 can be orderly stacked on the discharge tray 46.

By discharging paper that is curved along the widthwise direction in this way, the paper is less likely to droop and push previously discharged paper stacked on the discharge tray 46. Further, the convex part in the paper is supported by the guide ribs 73 to ensure that the paper is conveyed reliably.

As shown in FIG. 6, a vertical distance H1 is defined as a distance between the lower edges 71 of the guide ribs 73 and the top surface 47 at the front edge 100*c*. As shown in FIG. 5, a vertical distance H2 is defined as a vertical distance between the top surface 47 and the nip P2 between the discharge rollers 45 at the rear end of the discharge tray 46. The vertical distance H1 is substantially equal to the vertical distance H2. This construction keeps the vertical position of the control panel 100 as low as possible while reliably discharging paper equivalent to the amount that can be stacked on the discharge tray 46.

As shown in FIG. 6, the control panel 100 has a vertical height H4 that is greater than a shortest vertical distance H3 between the lower edges 71 of the guide ribs 73 and the document support surface 76*a* of the main reading unit body 170. Therefore, while providing the main reading unit body 170 with various functions for scanning original documents, the main reading unit body 170 can be maintained at a small height, thereby keeping down the overall height of the multifunction device 1.

As shown in FIGS. 1 and 5, a static eliminating brush 75 protrudes downwardly from the underside surface 70*a* of the image reading unit 70 for removing a static charge from paper discharged from the discharge rollers 45. The static eliminating brush 75 has: a holder part 75*b* that is attached to the reader casing 170*b*; and a brush part 75*a* that is held by the holder part 75*b* to be located below the lower edges 71 of the guide ribs 73. The static eliminating brush 75 extends in the widthwise direction (Z-axis).

It is noted that the static eliminating brush 75 may extend continuously across a prescribed range in the widthwise direction. Or, several static eliminating brushes 75 may be provided at intervals across the prescribed range in the widthwise direction.

The width of the range in which the static eliminating brush 75 extends in the widthwise direction (Z-axis) of the multifunction device 1 is approximately the same as or greater than the width of paper discharged from the discharge rollers 45. The brush part 75*a* of the static eliminating brush 75 is positioned to contact or approach paper discharged from the discharge rollers 45 across the entire width of the paper.

The static eliminating brush 75 may have either a self-discharging or a grounded configuration that is capable of removing a charge from the paper.

With this construction, the static eliminating brush 75 can reliably prevent the paper 3 from sticking to the lower edges 71 of the guide ribs 73.

If the device 1 has no static eliminating brush and paper is discharged from the discharge rollers 45 and stacked while still in an electrically charged state, subsequent sheets of paper will not be reliably conveyed and stacked thereon. According to the present embodiment, by providing the static eliminating brush 75, these problems are resolved, enabling the paper 3 to be conveyed and stacked reliably.

As shown in FIGS. 1 and 5, a sensor 78 is attached to the reader casing 170*b* to protrude downwardly from the underside surface 170*a* for detecting when the amount of paper discharged from the discharge rollers 45 and stacked on the discharge tray 46 becomes excessive.

The sensor 78 is a rotatable lever-shaped member that detects when the amount of stacked paper is excessive based on the rotational angle of the lever. In the normal state, a tip end (lower end) of the sensor (lever) 78 is positioned lower than the lower edges 71 of the guide ribs 73. The sensor lever 78 rotates when the paper contacts the sensor lever 78. For example, the sensor 78 may be configured to detect an excessive amount of stacked paper when the lever remains at a slant for a prescribed amount of time. The sensor 78 can effectively prevent problems associated with the overstacking of paper 3. Further, since the sensor 78 is provided on the underside surface 170*a*, the configuration allows for more freedom of design.

The discharge angle θ of the discharge rollers 45 has such an amount that when a paper is discharged by the discharge rollers 45 at the discharge angle θ, that is, diagonally upward, the paper contacts the lower edges 71 of the guide ribs 73 as shown in FIG. 5.

It is noted a path of a leading edge of paper discharged from the discharge rollers 45 depends on the weight and the hardness of the paper. A standard paper, PPC paper XEROX 4024 (A4) (trade name), for example, has average stiffness and average weight among almost all the kinds of papers usable in the multifunction device 1. When standard paper is discharged from the discharge rollers 45, the leading edge of the standard paper traces a path L1 within a region C1 over the upstream portion 46*b* of the discharge tray 46 as shown in FIG. 5. According to the present embodiment, therefore, the shape of the top surface 47 on the upstream portion 46*b* is configured to be substantially parallel to the path L1 within the XY plane.

As shown in FIG. 6, the lower panel surface 100*b* of the control panel 100 and the lower edges 71 of the guide ribs 73 slant downward toward the front of the multifunction device 1. The leading edge of the standard paper discharged from the discharge rollers 45 traces a path L2 when moving through a region C2 near the downstream end of the image reading unit 70. According to the present embodiment, therefore, the shape of the lower panel surface 100*b* in the region C2 (declining extension 79) and the lower edges 71 of the guide ribs 73 in the region C2 are configured to be substantially parallel to the path L2 in the XY plane.

The standard paper discharged from the discharge rollers 45 first contacts the lower edges 71 of the guide ribs 73 at a contact position P4. The lower edge 71 of each guide rib 73 is configured at the position P4 so that the lower edge 71 forms an angle of 20° or less with the paper surface near the leading edge of the paper. It is noted that if either one or both of the lower edge 71 and the leading edge of the paper are curved at the contact position P4, then the angle formed by the lower edge 71 and the paper surface at this point is defined by tangents to the curves at the contact position P4. In other words, if both the lower edge 71 and the leading edge of the paper are curved at the contact position P4, then the angle formed between a tangent to the lower edge 71 and a tangent to the standard paper surface at the contact position P4 is configured to be no more than 20°.

With this construction, when the paper first contacts the lower edges 71 of the guide ribs 73, the paper does not receive a strong impact from the lower edges 71 of the guide ribs 73, but softly contacts and smoothly slides over the lower edge 71.

A line L3 is defined to extend straight from the nip P2 of the discharge rollers 45 along the tangential direction thereof. The line L3 intersects the lower edges 71 of the guide ribs 73 at an intersecting point P3 as shown in FIG. 5. When a slightly stiffer paper than the standard paper is discharged from the discharge rollers 45, the paper traces the path similar to the line L3.

According to the present embodiment, the lower edge 71 of each guide rib 73 is configured at the position P3 so that the line L3 also forms an angle of no more than 20° with the lower edge 71 at the intersecting point P3. In this case, if the lower edge 71 is formed in a curve at the intersecting point P3, then the angle formed between the line L3 and a tangent to the lower edge 71 at the intersecting point P3 is configured to be no more than 20°. This configuration can reduce the impact of the paper on the lower edge 71, even when the paper is a slightly stiffer paper than the standard paper.

When forming an image on paper of the maximum size that can be used in the multifunction device 1, the entire sheet of paper has to completely pass the transfer position P1 by the time the leading edge of the paper discharged from the discharge rollers 45 contacts the lower edges 71 of the guide ribs 73. In other words, the length of the path for conveying paper from the transfer position P1 to the contact position P4 shown in FIG. 1 is greater than the length of the maximum paper size that can be used in the multifunction device 1. Since vibrations generated when the paper contacts the lower edge 71 are not transferred along the paper to the transfer position P1, this configuration prevents adverse effects on the image transfer process. Therefore, such vibrations do not produce distortions in the transferred image, enabling a precise transfer operation.

As described above, the multifunction device 1 includes the image-forming unit 5 for forming images, the discharge tray 46 provided above the image-forming unit 5 for supporting paper discharged from the paper discharge rollers 45, and the reading unit 70 positioned to cover the top of the discharge tray 46 so that the top surface 47 of the discharge tray 46 opposes the bottom surface 70*a* of the reading unit 70. The paper discharge rollers 45 are configured to discharge paper at an angle to the horizontal that enables the discharged paper to contact the bottom surface 70*a* of the reading unit 70. In the reading unit 70, the control panel 100 is provided on the front side of the main reading body 170. The opening 82 is defined between the control panel 100 and the discharge tray 46. A user can pick up the paper discharged on the discharge tray 46 through the opening 82. Both of the upper surface 100*a* and the lower surface 100*b* of the control panel 100 are slanted to extend forwardly downwardly.

The multifunction device 1 has the paper cassette 6 disposed in the bottom section of the multifunction device 1 for accommodating stacked sheets of the paper 3; a conveying path positioned above the paper cassette 6 for conveying the paper 3 accommodated in the paper cassette 6 out of the multifunction device 1 via the transfer position P1; the feed roller 8 positioned above and near the front end of the paper cassette 6 for supplying the topmost sheet of paper 3 stacked on the paper cassette 6 along the conveying path; and the process unit 17 accommodating the photosensitive drum 27 and the toner box 34, disposed above the paper cassette 6 and near the feed roller 8. The process unit 17 can be removed from the multifunction device 1 along a path that extends in a substantially horizontal detaching direction that passes over the feed roller 8. The multifunction device 1 also includes the scanning unit 16 disposed above the process unit 17 and provided with at least the polygon mirror 19.

The scanning unit 16 is tapered toward the front in the detaching direction of the process unit 17 so that the side of the scanning unit 16 near the feed roller 8 is thinner to facilitate removal of the process unit 17. A portion of the conveying path is formed in an area between the process unit 17 and the paper cassette 6. The transfer position P1 on the conveying path is positioned lower than the top edge of the feed roller 8.

This construction facilitates the removal of the process unit 17. Further, by tapering the scanning unit 16 to be thinner in the area directly above the feed roller 8, the height of the multifunction device 1 at a position corresponding to the feed roller 8 can be made smaller than when the scanning unit 16 is not tapered.

Further, the position of the process unit 17 and the like can be lowered by the amount that the transfer position P1 is lower than the top of the feed roller 8, thereby reducing the height of the multifunction device 1 at the transfer position P1. Further, since the process unit 17 includes the photosensitive drum 27 and the transfer roller 30, the photosensitive drum 27 and transfer roller 30 can also be replaced when replacing the process unit 17.

As shown in FIG. 1, the upstream side edge 46*a* of the discharge tray 46 is positioned at a lower position than the top edge of the fixing unit 18. Therefore, in comparison with a comparative case where the upstream side edge 46*a* is positioned higher than the top edge of the fixing unit 18, the position of the pair of discharge rollers 45 can be lowered, without reducing the maximum number of stackable sheets of paper 3 in the discharge tray 46. Thus, the height of the portion of the multifunction device 1, under which the scanning unit 16 is disposed, can be made closer to the height of another portion of the multifunction device 1, under which the pair of discharge rollers 45 are disposed. This structure contributes to the improvement of the design of the multifunction device 1.

The present embodiment facilitates removal of the process unit 17 and reduces the height of the multifunction device 1 at the position of the feed roller 8 by making the scanning unit 16 in a tapered shape. Further, since the process unit 17 can be positioned lower by the amount that the transfer position P1 is lower than the top of the feed roller 8, the height of the multifunction device 1 at the transfer position P1 can be reduced.

The discharge rollers 45 discharge paper diagonally upward and convey the paper so that the leading edge contacts the lower edges 71 of the guide ribs 73 at a position P4. The lower edges 71 of the guide ribs 73 guide the discharged paper forward.

With this construction, the paper can be discharged from the discharge rollers 45 without pushing off previously discharged paper resting on the discharge tray 46 and can be guided forward along the lower edges 71 of the guide ribs 73 to be appropriately positioned on the discharge tray 46.

Further, by forming the grip part 77 as a depression, the grip part 77 does not impede the discharged paper 3, enabling the paper to be conveyed reliably.

It is possible to convey discharged paper along the lower edges 71 of the guide ribs 73 while maintaining only a small area of contact between the discharged paper and the lower edges 71 of the guide ribs 73. Accordingly, it is possible to reduce resistance in the conveying operation and to effectively prevent the paper from sticking to the lower edges 71 of the guide ribs 73 due to static electricity, thereby achieving more reliable paper conveyance.

The shape of the top surface 47 in the upstream portion 46*b* (region C1) and the shapes of the lower panel surface 100*b* and the lower edges 71 of the guide ribs 73 in the region C2 are determined to extend parallel with the conveying path of the standard paper. Accordingly, almost all the kinds of papers that are usable in the multifunction device 1 can be suitably guided and stacked on the tray 46.

More specifically, almost all the kinds of papers that are usable in the multifunction device 1 can be discharged along the lower edges 71 of the guide ribs 73. The behavior of the papers during discharge is stable. Hence, the present embodiment achieves a compact device that conveys paper in a stable manner.

For almost all the kinds of papers that are usable in the multifunction device 1, the leading edge of the sheet of paper discharged from the discharge rollers 45 traces a path that closely parallels the planar surface of paper already discharged and supported on the discharge tray 46 on the upstream side with respect to the direction that paper is discharged from the discharge rollers 45. Accordingly, the discharged sheet of paper can be stacked reliably without pushing off paper that has already been discharged.

The leading edge of the paper discharged from the discharge rollers 45 has an upwardly convex shape in the paper discharging direction. Hence, the leading edge of the paper does not incur much shock from the lower edges 71 of the guide ribs 73, but smoothly contacts the lower edges 71 of the same.

The image reading unit 70 can be raised upward as shown in FIG. 9(*a*). Accordingly, the control panel 100 can also be moved upward so as to separate the lower panel surface 100*b* from the top surface 47 of the discharge tray 46. With this construction, it is possible to open the control panel 100 when needed, enabling the user to access areas below the control panel 100 or toward the rear side of the discharge tray 46. Hence, this construction prevents or eliminates operating difficulties or discharge problems that can result when making a device compact, improving operating efficiency and user-friendliness.

Paper fed from the front side of the paper cassette 6 by the conveying roller 11, feed roller 8, and pinch roller 10 is reversed in direction by the guide unit 55 so as to be moving toward the rear of the multifunction device 1. In this way, the paper is conveyed to the image-forming unit 5 disposed above the paper cassette 6. After the image-forming unit 5 forms a prescribed image on the paper and the image is fixed by the fixing unit 18, the conveying direction of the paper is reversed toward the front by the guide members 52 and 53. Subsequently, the pair of the discharge rollers 45 discharge the paper onto the discharge tray 46 disposed above the image-forming unit 5. This construction can achieve a compact device without impediments to discharged paper, and can thereby reliably discharge paper.

The multifunction device 1 is configured by vertically stacking the main reading unit body 170, the paper cassette 6, and the image-forming unit 5 so that the overall height of the device 1 is determined by the sum of the heights of these components. The height of the multifunction device 1 can be reduced by reducing the height H3 of the main reading unit body 170. Since the lower panel surface 100*b* of the control panel 100 slopes downward toward the front 100*c* of the device 1, the top surface 100*a* of the control panel 100 can be disposed slant downward toward the front side 100*c* while restraining the height H3 of the main reading unit body 170, thereby enhancing the user's ability to view and operate the control panel 100. That is, the user can easily view and operate the control panel 100 because the top surface 100*a* of the control panel 100 slants downward toward the front side 100*c* of the device at a certain degree of slope.

The top surface 100*a* of the control panel 100 slopes downward toward the front to enable a user to view and operate the control panel easily. The multifunction device 1 has the thin flatbed portion between the document support surface 76*a* and the underside surface 170*a* of the main scanning body 170 (H3 in FIG. 6). If the bottom plate 100*b* of the control panel 100 is level or is sloped upward toward the front of the device when increasing the vertical height of the control panel 100 (H4 in FIG. 6), it will be necessary to increase the overall height of the apparatus 1 excessively to accommodate the height of the control panel 100, making the manufacturing of a compact device difficult. However, according to the present embodiment, by sloping both the upper panel surface 100*a* and the lower panel surface 100*b* downward toward the front of the apparatus 1, the height of the apparatus 1 can easily be suppressed while maintaining the slope of the upper panel surface 100*a* to facilitate viewing and operations, even when the flatbed section is made thinner.

Because the opening 84*a* is formed in the front side, that is, the downstream side in the paper discharging direction, the user can mount and remove the process unit 17 and access discharged paper from the downstream side with respect to the paper discharging direction, thereby enhancing user-friendliness.

By integrating the underside surface 170*a* and the lower panel surface 100*b*, this construction eliminates impediments to the discharged paper 3 such as unevenness caused by separation between these two parts.

The guide ribs 73 protrude farther downward than the bottom edge of the grip part 77 so that discharged paper does not catch on the grip part 77 when sliding along the lower edges 71 of the guide ribs 73 near the grip part 77.

In the above description, the guide ribs 73 extend entirely from the upstream side position 170*c* to the front edge 100*c*. The upstream side position 170*c* is located exactly above the upstream side edge 46*a* of the discharge tray 46. However, the guide ribs 73 may not extend entirely from the upstream side position 170*c* to the front edge 100*c*. The guide ribs 73 may be provided at the minimum to pass through the contact position P4. That is, the guide ribs 73 may be formed from a position on the rear side of the contact position P4 continuously forwardly to the front edge 100*c*. In other words, the rear edges of the guide ribs 73 may be located at any position on the rear side of the contact position P4 in the front-to-rear direction.

The grip part 77 may be located at the contact position P4 or on the front side of the contact position P4 in the front-to-rear direction. In this case, the discharge rollers 45 discharge paper diagonally upward so that the leading edge contacts the lower edges 71 of the guide ribs 73 at a position corresponding to the grip part 77 or at a position farther toward the pair of the discharge rollers 45 from the grip part 77. Also in this case, the lower edges 71 of the guide ribs 73 guide the discharged paper forward.

It is noted that in the above description, as shown in FIG. 7, the lower edges 71 of the guide ribs 73 are positioned lower toward the widthwise ends than in the center. However, the guide ribs 73 may also be configured to have the same height.

Instead of the static eliminating brush 75, a static eliminating needle, or a conductive film may be provided on the underside surface 70*a*, or a conductive resin material may be provided on the underside surface 70*a*.

It is noted that the vertical positional relationship between the pair of discharge rollers 45 and the lower edges 71 of the guide ribs 73 is not limited to the example shown in FIG. 7, provided that the pair of discharge rollers 45 discharges the paper in a curved state and that the positions of the lower edges 71 of the guide ribs 73 are configured to form the same curved shape.

For example, the degree of curvature may be less than that shown in FIG. 7; the vertical distance between the pair of discharge rollers 45 and the lower edges 71 of the guide ribs 73 may be slightly decreased or increased; and the guide ribs 73 need not be spaced at regular intervals.

Second Embodiment

Next, a multifunction device according to a second embodiment of the present invention will be described with reference to FIGS. 11 and 12.

Figure 11:
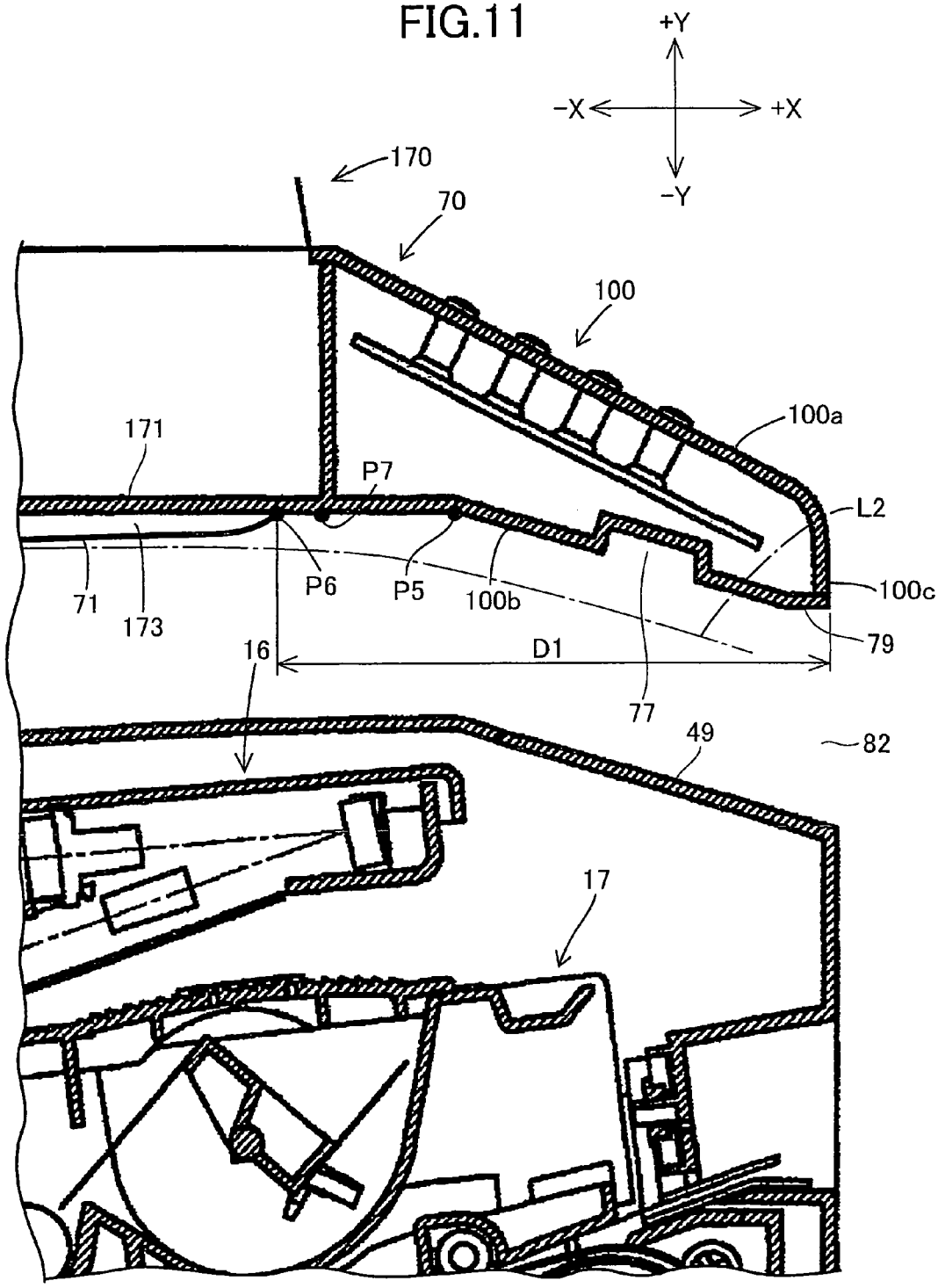
FIG. 11 is an enlarged side cross-sectional view showing the relevant part of a multifunction device according to a second embodiment.
Figure 12:
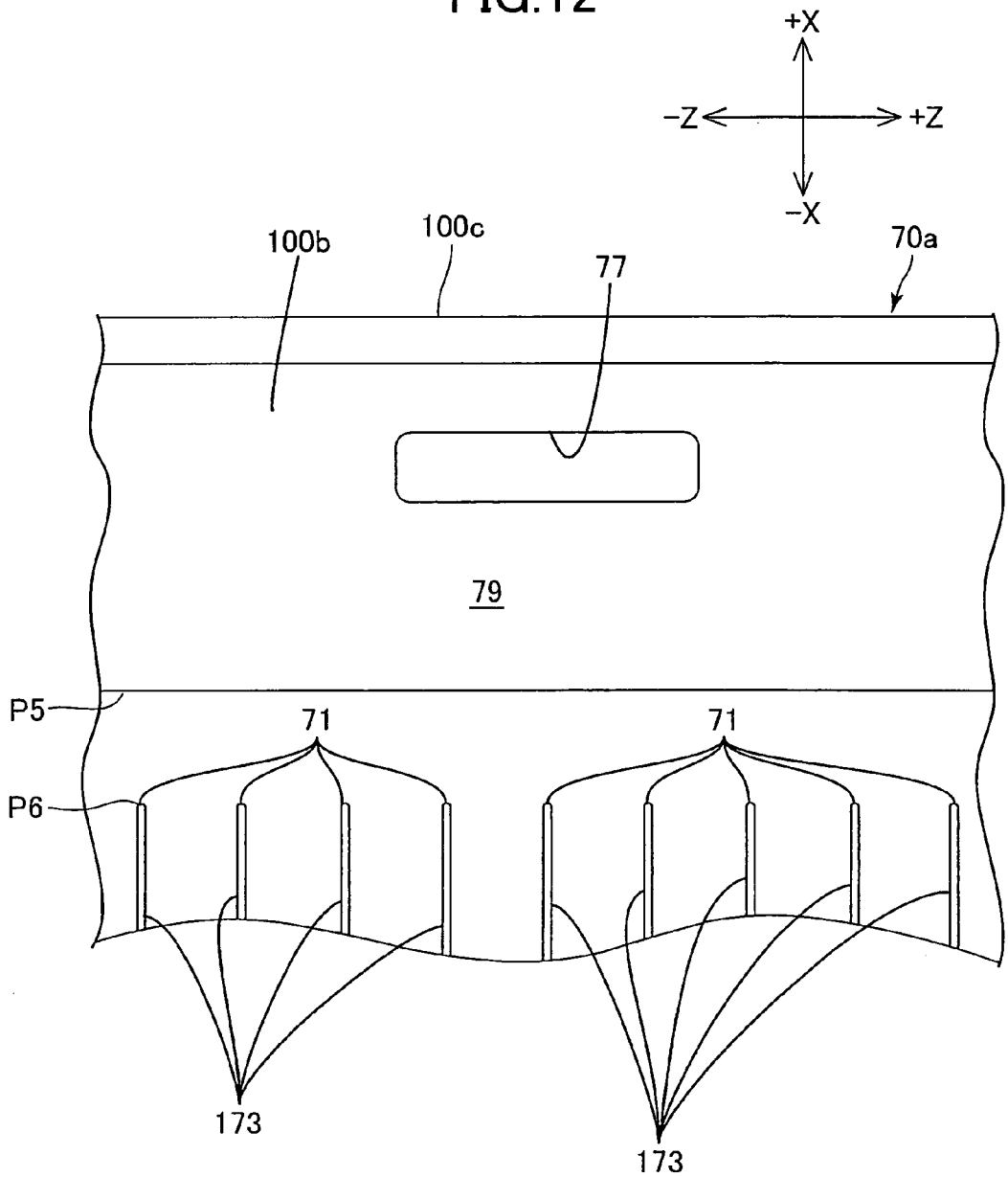
FIG. 12 is an enlarged bottom view showing part of the reading unit in the multifunction device according to the second embodiment.

FIG. 11 shows an expanded view of the area relevant to the second embodiment. FIG. 12 is an explanatory diagram showing the lower panel surface 100*b* of the control panel 100 according to the second embodiment. The second embodiment differs from the first embodiment only in the shape of the guide ribs. Parts other than the guide ribs are identical to those in the first embodiment and, hence, a description of these parts has been omitted. Further, like parts and components have been designated with the same reference numerals.

As in the first embodiment, the declining extension 79 forms a portion of the image reading unit 70 on the front side and slopes downward gradually toward the front. However, guide ribs 173 are located within the area rearward of a rear edge P5 of the declining extension 79. That is, a leading edge P6 of the guide ribs 173 is positioned farther rearward than the rear edge P5 of the declining extension 79.

This construction eliminates the need to construct guide ribs 173 on both the declining extension 79 and the part rearward of the declining extension 79, but only on the part rearward of the declining extension 79. This simplifies the design, and enables the guide ribs 173 to be formed more precisely.

As in the first embodiment, the grip part 77 for lifting the image reading unit 70 upward is formed on the lower panel surface 100*b* of the image reading unit 70 in the second embodiment. The grip part 77 is located on the declining extension 79. The front edges P6 of the guide ribs 173 in the second embodiment are located on the rear side of the grip part 77.

This construction effectively prevents or reduces the chance of the user's hand coming into contact with the guide ribs 173 when operating the grip part 77, making the feel of the operation more pleasant to the user.

Further, while the second embodiment is provided with the same control panel 100 provided in the first embodiment, the guide ribs 173 are disposed within an area to the rear of the control panel 100. In other words, the leading edge P6 of the guide ribs 173 is positioned farther rearward than a rear edge P7 of the control panel 100.

In the second embodiment, the opening 82 is formed between the front part of the discharge tray 46 and the cover 49 and the front part of the control panel 100, as in the first embodiment. A distance D1 between the leading edge P6 of the guide ribs 173 and the front edge of the opening 82 (the front edge 100*c* of the control panel 100) in the front-to-rear direction is at least 5 cm. Since 5 cm or more separates the front edge of the opening 82 from the leading edge P6, the user is not likely to touch the guide ribs 73 when putting a hand in the opening 82.

Hence this construction reduces the chance of the user's hand bumping against or contacting the guide ribs 173 when the user puts a hand into the paper discharge opening, thereby improving operability.

The configuration described above is only one example. The guide ribs 173 may also be configured such that the leading edge P6 of the guide ribs 173 is positioned in front of the rear edge P5 of the declining extension 79, but behind the grip part 77, or behind the grip part 77 but in front of the rear edge P7 of the control panel 100. The leading edge P6 of the guide ribs 173 may also be positioned rearward of the rear edge P5 but forward of the rear edge P7.

Third Embodiment

Next, a multifunction device according to a third embodiment will be described with reference to FIG. 13.

Figure 13:
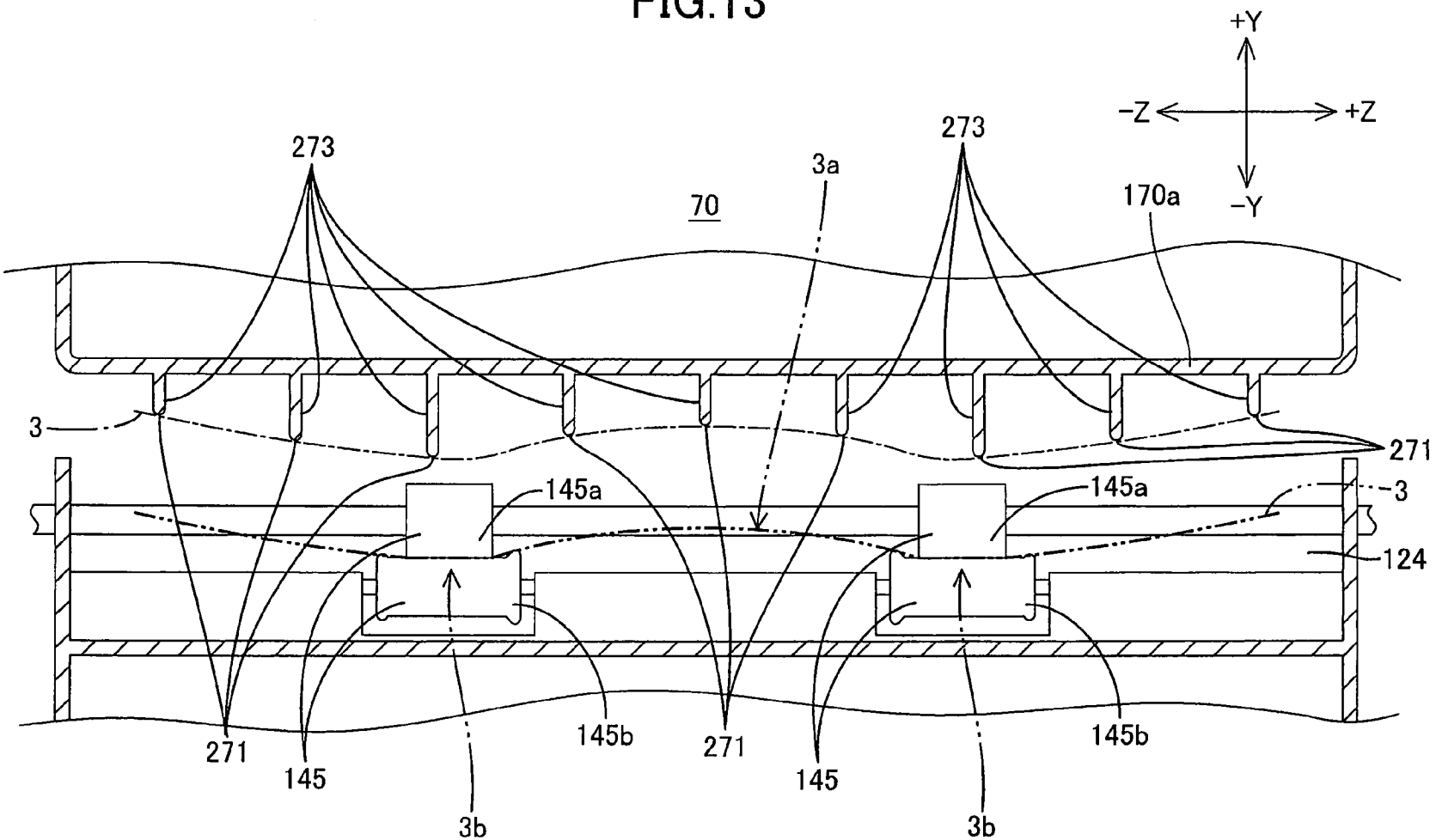
FIG. 13 is an explanatory diagram showing the structure around the paper discharge port in a multifunction device according to a third embodiment.

FIG. 13 shows a variation of the construction shown in FIG. 7. In the third embodiment, the shapes of the paper discharge rollers and the guide ribs differ from those in the first and second embodiments. Except for the structure of the paper discharge rollers and the construction of the guide ribs, the remaining construction is identical to that described in the first and second embodiments, and the description of this construction has been omitted. Further, like parts and components are designated with the same reference numerals to avoid duplicating description.

In the multifunction device 1 according to the third embodiment, the paper discharge rollers 145 at the paper discharge outlet 124 are configured to discharge paper so that a convex part 3*a* is formed in a portion of the paper in the widthwise direction, and concave parts 3*b* that are concave on the top side of the paper 3 are formed at different positions than the convex part 3*a* in the widthwise direction. Guide ribs 273 have lower edges 271 set at positions conforming to the shapes of the convex part 3*a* and concave parts 3*b*. Hence, the paper discharge rollers 145 are configured to discharge the paper in an undulated state. At the same time, the ends 271 of the guide ribs 273 follow the shape of the discharge paper. Hence, the guide ribs 273 are configured to absorb impact and friction with the paper over the entire width of the paper.

The paper is discharged through the paper discharge outlet 124 by the pairs of discharge rollers 145. In the preferred embodiment, each pair of the discharge rollers 145 includes one curved roller 145*b* and a roller 145*a* having a smaller width than the curved roller 145*b*. The curved roller 145*b* and roller 145*a* rotate while in contact with each other so that a sheet of paper being discharged by the discharge rollers 145 is partially curved in the widthwise direction. In the example shown in FIG. 13, two of the curved rollers 145*b* are provided, thereby generating the concave parts 3*b* in two locations. The formation of the concave parts 3*b* also produces a convex part 3*a* between the concave parts 3*b* so that the paper is undulated across the entire width when discharged from the paper discharge rollers 145.

Since the lower edges 271 of the guide ribs 273 conform to the curvature of the paper with this construction, the curved paper can be guided by the guide ribs 273 with suitable support.

Fourth Embodiment

Figure 14:
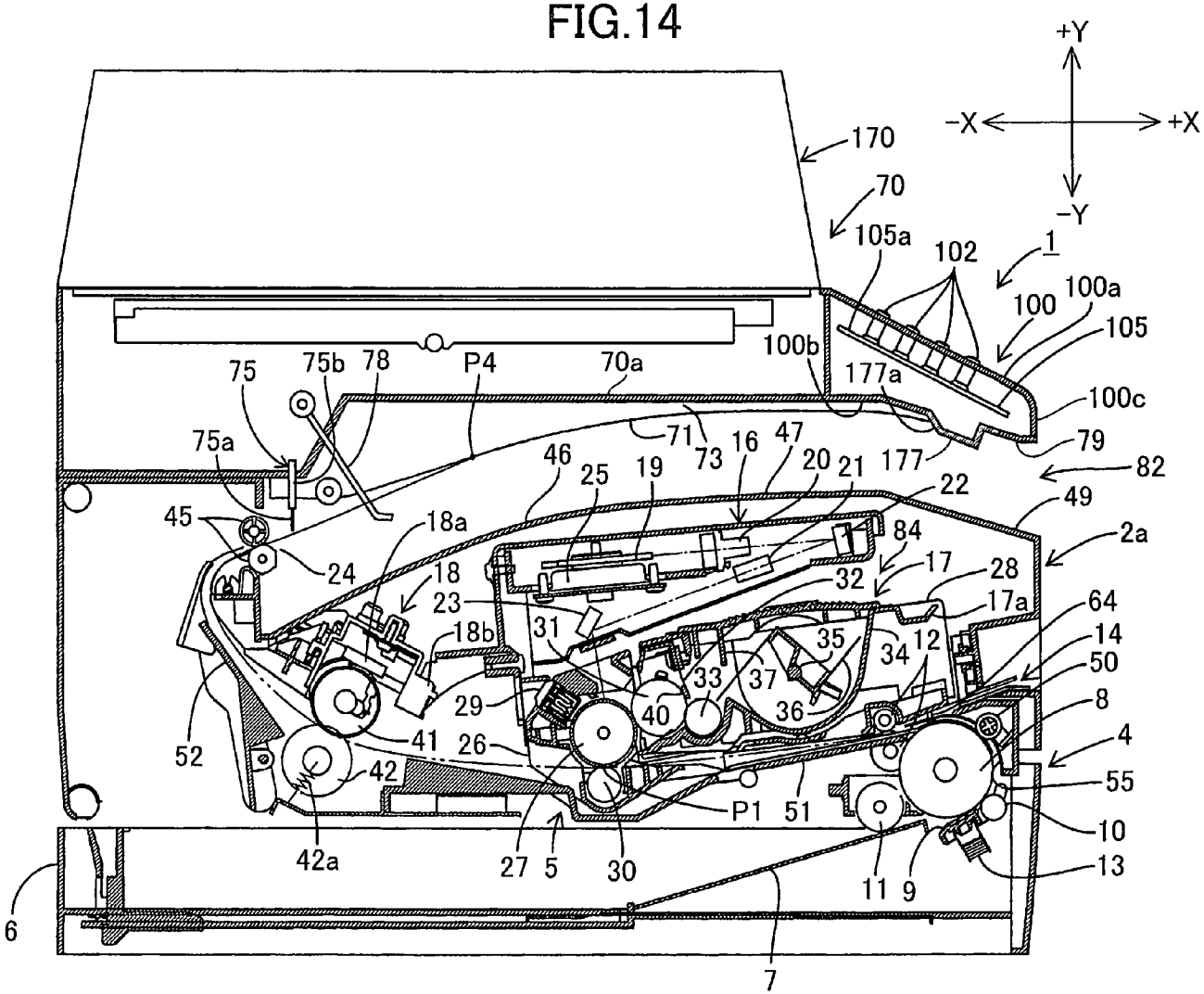
FIG. 14 is a side cross-sectional view showing a multifunction device according to a fourth embodiment.

Next, a multifunction device according to a fourth embodiment of the present invention will be described with reference to FIG. 14. In the fourth embodiment only the shape of the grip part differs from that in the first embodiment. The remaining structure of the multifunction device is substantially the same as that in the first embodiment, and a detailed description of this structure has been omitted. Further, like parts and components have been designated with the same reference numerals. As shown in FIG. 14, a grip part 177 for moving the image reading unit 70 is configured as a protrusion that protrudes downward from the underside surface 70*a* of the image reading unit 70. The grip part 177 has a beveled part 177*a* on the surface nearest the pair of the discharge rollers 45. The beveled part 177*a* is sloped at an angle less than 90°, and preferably around 45°, with the lower panel surface 10*b* of the control panel 100. When the paper moves by the grip part 177 during a discharge operation, the beveled part 177*a* formed on the grip part 177 is configured to guide the paper forward without applying much resistance.

As in the first embodiment, the discharge rollers 45 of the fourth embodiment are configured to discharge the paper at an upward and forward slant. While being conveyed by the discharge rollers 45, the discharged paper contacts the lower edges 71 of the guide ribs 73 at a position that is rearward of the grip part 177 toward the pair of the discharge rollers 45 (specifically the contact position P4 described in the first embodiment). The paper is then guided forward along the lower edges 71 of the guide ribs 73. However, the multifunction device may be configured to discharge paper so that the paper directly contacts the grip part 177 on the underside surface 70*a*. With this configuration, the beveled part 177*a* can effectively suppress effects of the impact.

Fifth Embodiment

Next, a multifunction device according to a fifth embodiment of the present invention will be described with reference to FIG. 15.

The fifth embodiment differs from the first embodiment in that follow rollers are disposed on the bottom surface of the image reading unit 70. The remaining structure is identical to that described in the first embodiment, and a detailed description of this structure has been omitted. Further, like parts and components have been designated with the same reference numerals.

In addition to the construction of the first embodiment, the multifunction device of the fifth embodiment is further provided with follow rollers disposed on the underside surface 170*a* of the image reading unit 70. The follow rollers roll along with the movement of paper discharged through the paper discharge port 24 in response to contact from the paper. In this example, the follow rollers are configured of a spur 120 and a roller 122 that are rotatably supported on the underside surface 170*a* of the main reading unit body 170. When discharged paper contacts the spur 120 and the roller 122, the spur 120 and roller 122 guide the discharged paper, reducing friction generated between the paper and the lower edges 71 of the guide ribs 73.

Figure 15:
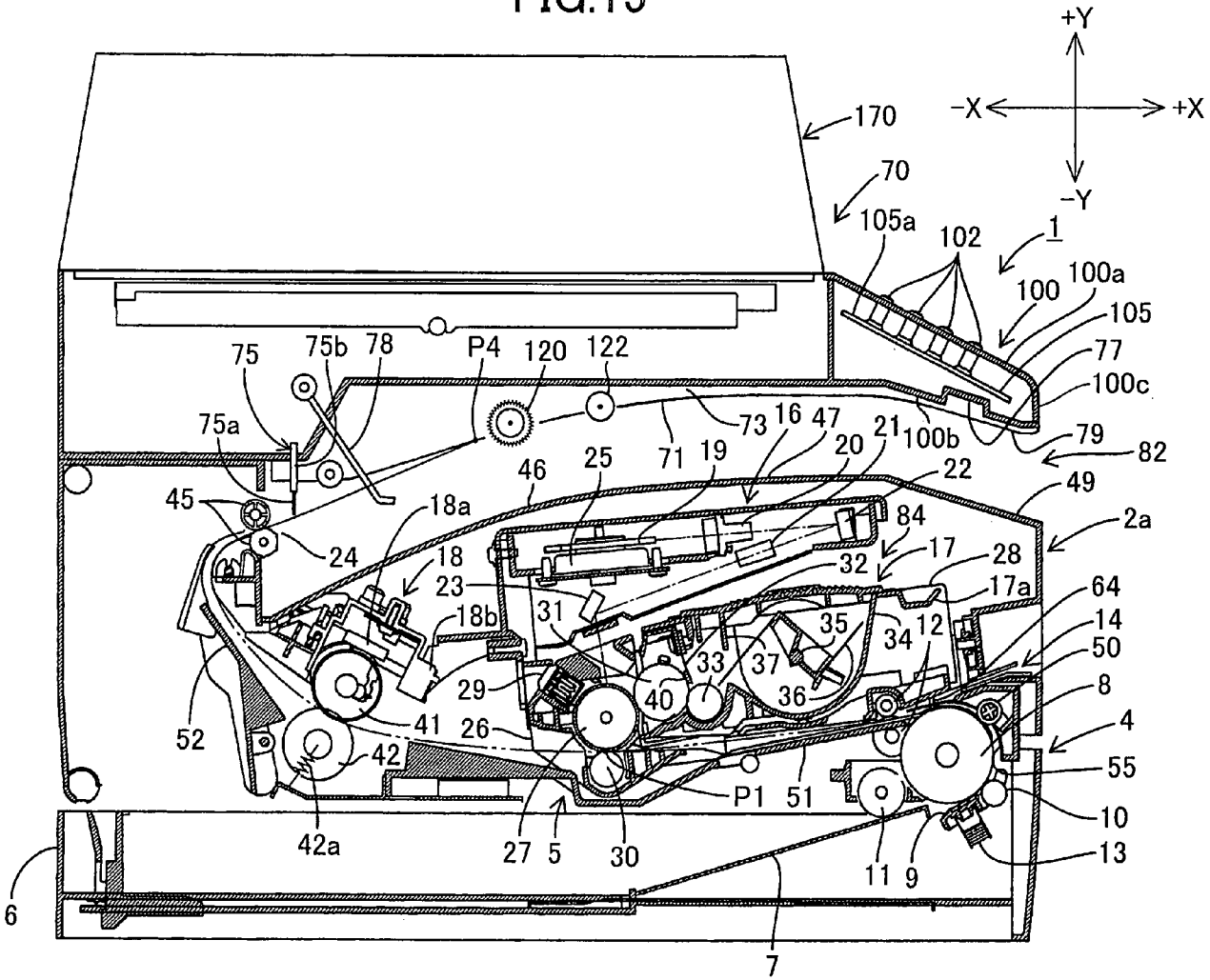
FIG. 15 is a side cross-sectional view showing a multifunction device according to a fifth embodiment.

While the guiding effects of the underside surface 170*a* are enhanced by providing both the guide ribs 73 and the spur 120 and roller 122 as in the example shown in FIG. 15, it is also possible to omit the guide ribs 73 from the underside surface 170*a*. In this case, the underside surface 70*a*, per se is configured to have the same shape with the lower edges 71 of the guide ribs 73 of the first embodiment in the XY plane. It is also possible to provide only the spur 120, only the roller 122, or a plurality of the spurs 120 or rollers 122.

While the invention has been described in detail with reference to specific embodiments thereof, it would be apparent to those skilled in the art that many modifications and variations may be made therein without departing from the spirit of the invention, the scope of which is defined by the attached claims.

(1) For example, the multifunction device of the embodiments described above is capable of forming images on various types of paper. However, the present invention may also be applied to a multifunction device that can form images on transparency sheets, fabric, or the like.

(2) Further, the multifunction device may be configured to allow an operator to remove only the developing cartridge 28, while the drum cartridge 26 of the process unit 17 remains in the multifunction device 1.

What is claimed is:

1. An image-forming device comprising:

an image-forming unit forming images on a recording sheet;

a sheet discharge unit discharging, in a sheet discharging direction, a recording sheet formed with an image by the image-forming unit;

a sheet support unit disposed above the image-forming unit, and supporting sheet discharged from the sheet discharge unit;

a top cover disposed above the sheet support unit so as to cover the sheet support unit with a underside surface of the top cover opposing a top surface of the sheet support unit, the top cover having a front side and a rear side in the sheet discharge direction, the front side being on a downstream side of the rear side in the sheet discharge direction; and a panel disposed on the front side of the top cover and comprising at least one of a control unit and a display unit on the top thereof;

an opening being formed between the panel and the sheet support unit through which the recording sheet can be retrieved; and a top surface and a underside surface of the panel sloping downward from the rear side to the front side, wherein the top surface of the sheet support unit slopes downward toward the front in a region opposing the underside surface of the panel.

2. An image-forming device according to claim 1, wherein the top surface of the sheet support unit slopes at substantially the same degree as the underside surface of the panel in the region opposing the underside surface of the panel.

3. An image-forming device according to claim 1, wherein the panel can be moved upward such that the underside surface of the panel separates from the top surface of the sheet support unit.

4. An image-forming device according to claim 1, further comprising a panel circuit board disposed inside the panel and connected to the at least one of the control unit and the display unit;

wherein the panel circuit board has a board surface that slopes at substantially the same degree as at least one of the top surface and underside surface of the panel.

5. An image-forming device according to claim 1, further comprising a casing disposed below the sheet support unit and around the image-forming unit, wherein a front part of the panel and a front part of the casing occupy substantially the same position in the front-to-rear direction.

6. An image-forming device according to claim 1, wherein a vertical distance between the top surface of the sheet support unit and the underside surface of the panel at the front part of the panel is substantially equal to a vertical distance between the top surface of the sheet support unit and the sheet discharge unit at a rear part of the sheet support unit.

7. An image-forming device according to claim 1, wherein the top cover includes a reading unit capable of reading an original document.

8. An image-forming device according to claim 7, wherein the reading unit has a document support surface that supports thereon an original document; and the vertical height of the panel is set larger than the shortest vertical distance between a underside surface of the reading unit and the document support surface.

9. An image-forming device according to claim 7, wherein the reading unit is capable of moving upward so that the underside surface of the reading unit separates away from the top surface of the sheet support unit.

10. An image-forming device according to claim 7, wherein the underside surface of the reading unit and the underside surface of the panel are molded as an integral unit.

11. An image-forming device according to claim 1, further comprising:

a main casing that has the image-forming unit therein, wherein the image-forming unit includes:

an image-carrying member on which electrostatic latent images are formed when the image-carrying member is exposed to a laser beam; and a polygon mirror that scans a laser beam over the image-carrying member to form latent images on the image-carrying member, the latent images being subsequently developed into visible images by a developer, and the visible image being subsequently transferred onto a recording sheet at an image-transfer position;

the image-forming device further comprising:

a sheet cassette disposed below the image-forming unit and accommodating recording sheet in a stacked state;

a conveying path positioned above the sheet cassette and conveying sheet from the sheet cassette to the sheet support unit via the image-transfer position; and a feed roller positioned above and near the front of the sheet cassette and feeding a topmost sheet of sheet stacked in the sheet cassette along the conveying path;

wherein the image-forming unit further includes a process cartridge disposed near the feed roller and above the sheet cassette and having at least a developer accommodating unit that accommodates developer to be supplied to the image-carrying member and capable of being removed from the main casing in a substantially level detaching path that passes above the feed roller; and the image forming device further comprising a scanning unit disposed above the process cartridge and comprising at least the polygon mirror;

wherein the scanning unit is tapered in the process cartridge detaching direction so as to be thinner near the feed roller to facilitate removal of the process cartridge;

wherein a portion of the conveying path is formed in an area interposed between the process cartridge and the sheet cassette; and wherein the image-transfer position on the conveying path is positioned lower than a top edge of the feed roller.

12. An image-forming device according to claim 1, further comprising a main casing that has the image-forming unit therein, wherein the image-forming unit includes a process cartridge that is detachably mounted in the main casing and comprises at least an image-carrying member;

wherein the main casing comprises an accommodating portion formed below the sheet support unit and accommodating the process cartridge, and an opening formed in a front part of the main casing in communication with the accommodating portion; and the process cartridge is mounted to and removed from the main casing via the opening.

13. An image-forming device according to claim 1, further comprising:

a sheet cassette that can be pulled out from the front side of the image-forming device;

a first direction switching unit that conveys the sheet supplied from the sheet cassette to the image-forming unit disposed above the sheet cassette, while changing the conveying direction from a forward direction to a rearward direction; and a second direction switching unit that conveys sheet from the image-forming unit to the sheet discharge unit disposed above the image-forming unit, while changing the conveying direction from the rearward direction to the forward direction.

* * * * *